US012114781B2

(12) United States Patent
Shih

(10) Patent No.: US 12,114,781 B2
(45) Date of Patent: Oct. 15, 2024

(54) ELECTRIC BED

(71) Applicant: Chuan-Hang Shih, Changhua County (TW)

(72) Inventor: Chuan-Hang Shih, Changhua County (TW)

( * ) Notice: Subject to any disclaimer, the term of this patent is extended or adjusted under 35 U.S.C. 154(b) by 150 days.

(21) Appl. No.: 17/900,063

(22) Filed: Aug. 31, 2022

(65) Prior Publication Data

US 2024/0023720 A1 Jan. 25, 2024

(30) Foreign Application Priority Data

Jul. 21, 2022 (TW) ..... 111127439

(51) Int. Cl.
*A47C 20/04* (2006.01)

(52) U.S. Cl.
CPC ..... *A47C 20/041* (2013.01)

(58) Field of Classification Search
CPC ..... A47C 20/041; A47C 20/08
USPC ..... 5/616
See application file for complete search history.

(56) References Cited

U.S. PATENT DOCUMENTS 956,312 A * 4/1910 Dogilbert ..... A47C 20/041 318/120
1,481,756 A * 1/1924 Samuel ..... A47C 20/042 5/660
1,678,071 A * 7/1928 Heinrich ..... A47C 20/08 5/618
1,703,237 A * 2/1929 Holtkamp ..... A47C 20/043 5/618
1,731,251 A * 10/1929 McIntosh ..... A47C 20/042 5/83.1
1,740,906 A * 12/1929 Rothauszky ..... A47C 20/041 601/24
1,760,302 A * 5/1930 Dougherty ..... A47C 20/08 5/613
1,790,435 A * 10/1931 Müller ..... A47C 20/08 5/618
1,828,980 A * 10/1931 Nixon ..... A47C 20/046 74/547
1,858,657 A * 5/1932 Bell ..... A47C 20/043 5/200.1
1,899,762 A * 2/1933 Logan ..... A47C 20/042 5/618
1,908,530 A * 5/1933 Nixon ..... A47C 20/046 5/618
1,941,263 A * 12/1933 McIntosh ..... A47C 20/08 5/618

(Continued)

*Primary Examiner* — Justin C Mikowski
*Assistant Examiner* — Luke Hall
(74) *Attorney, Agent, or Firm* — Muncy, Geissler, Olds & Lowe, P.C.

(57) ABSTRACT

An electric bed includes a base, a back supporting unit pivotally connected with the base, a first actuator to drive the back supporting unit to upwardly and downwardly swing relative to the base, a head supporting unit pivotally connected with the back supporting unit, and a second actuator to drive the head supporting unit to swing between an initial position and a head-up position relative to the back supporting unit. When the head supporting unit stays at the initial position, a head supporting surface of the head supporting unit is flush with a back supporting surface of the back supporting unit. The head-up position is lower than the initial position.

10 Claims, 10 Drawing Sheets

(56) References Cited

U.S. PATENT DOCUMENTS 1,941,264 A * 12/1933 McIntosh ..... A47C 20/043 74/548
1,973,699 A * 9/1934 Bradley ..... A47C 20/08 5/618
1,987,592 A * 1/1935 Bodmer ..... A47C 21/00 5/498
2,026,153 A * 12/1935 Wright ..... A47C 20/08 5/618
2,124,602 A * 7/1938 Teodoro ..... A47C 20/047 5/618
2,141,050 A * 12/1938 Smith ..... A47C 20/041 5/616
2,146,970 A * 2/1939 McGrew ..... A47C 20/048 5/618
2,202,383 A * 5/1940 Hymer ..... A47C 20/046 5/618
2,211,453 A * 8/1940 Buttikofer ..... A47C 20/041 5/616
2,247,516 A * 7/1941 Loudon ..... A47C 20/08 5/616
2,263,784 A * 11/1941 James ..... A47C 20/041 137/625.5
2,285,474 A * 6/1942 Urie ..... A47C 20/042 5/618
2,303,433 A * 12/1942 Bigelow ..... A47C 20/08 5/618
2,344,397 A * 3/1944 Drexler ..... A61G 7/015 5/616
2,349,701 A * 5/1944 Buttikofer ..... A47C 20/08 5/616
2,357,242 A * 8/1944 Wahl ..... A47C 20/08 5/154
2,397,092 A * 3/1946 Drexler ..... A61G 7/015 5/616
2,456,846 A * 12/1948 Thompson ..... A23L 2/54 318/120
2,468,765 A * 5/1949 Lorenz ..... A47C 20/08 5/618
2,481,477 A * 9/1949 Peery ..... F16H 25/205 475/2
2,500,742 A * 3/1950 Taylor ..... A47C 20/08 5/616
2,520,849 A * 8/1950 McVicker ..... A47C 20/048 5/618
2,536,534 A * 1/1951 Carter ..... A47C 20/08 5/616
2,605,481 A * 8/1952 Burkhart ..... A47C 20/08 5/616
2,617,118 A * 11/1952 Lorenz ..... A47C 20/08 297/91
2,631,300 A * 3/1953 Murray ..... A47C 20/042 5/616
2,639,443 A * 5/1953 Strybel ..... A47C 20/08 5/294
2,658,210 A * 11/1953 Don ..... A47C 20/08 5/618
2,663,358 A * 12/1953 Lorenz ..... A47C 20/08 5/618
2,699,688 A * 1/1955 Sutton ..... A47C 20/041 5/616
2,779,951 A * 2/1957 Don ..... A47C 20/08 5/616
2,802,219 A * 8/1957 Don ..... A47C 20/041 5/616
2,807,174 A * 9/1957 Helsel ..... A61G 7/015 403/339
2,819,474 A * 1/1958 Olsen ..... A61G 7/015 5/616
2,836,835 A * 6/1958 Wright ..... A61G 7/015 5/616
RE24,762 E * 1/1960 Sellner ..... A47C 20/08 297/320
2,938,572 A * 5/1960 Solloway ..... A47C 20/08 601/24
2,968,050 A * 1/1961 Shankman ..... A47C 20/08 5/618
2,996,732 A * 8/1961 Draper ..... A47C 20/08 5/616
3,003,160 A * 10/1961 Goodman ..... A47C 20/08 5/618
3,012,253 A * 12/1961 Reichert ..... A61G 7/002 5/616
3,022,523 A * 2/1962 Schmutz ..... A47C 20/08 5/241
3,051,965 A * 9/1962 Szemplak ..... A47C 20/042 5/616
3,059,248 A * 10/1962 Wetzler ..... A47C 20/08 5/618
3,061,843 A * 11/1962 Singer ..... A47C 20/08 5/618
3,077,612 A * 2/1963 Sevcik ..... A47C 17/48 5/618
3,087,170 A * 4/1963 Emery ..... A47C 20/08 5/660
3,089,150 A * 5/1963 Briggs ..... A47C 20/08 5/616
3,105,247 A * 10/1963 Katz ..... A47C 20/08 5/618
3,127,619 A * 4/1964 Bronstien ..... A47C 20/048 5/614
3,127,783 A * 4/1964 Martens ..... F16B 1/00 5/613
3,184,765 A * 5/1965 Katz ..... A47C 20/08 5/618
3,191,196 A * 6/1965 Holm ..... A61G 7/015 5/616
3,216,026 A * 11/1965 Mann ..... A61G 7/018 74/105
3,222,693 A * 12/1965 Pruim ..... A47C 19/045 5/616
3,230,554 A * 1/1966 Peterson ..... A47C 20/08 297/375
3,237,212 A * 3/1966 Hillenbrand ..... A61G 7/015 5/616
3,237,213 A * 3/1966 Birgbauer, Sr. ..... A47C 20/08 5/13
3,239,853 A * 3/1966 MacDonald ..... A61G 7/16 5/616
3,253,285 A * 5/1966 Fox ..... A47C 20/08 5/618
3,256,534 A * 6/1966 Benoit ..... A47C 20/041 200/43.16
3,257,670 A * 6/1966 Hanmore ..... A47C 20/08 5/618
3,261,639 A * 7/1966 Phillips ..... A47C 20/08 5/613
3,267,493 A * 8/1966 Pruim ..... A47C 20/041 5/618
3,278,952 A * 10/1966 Holm ..... A47C 20/08 5/616
3,283,342 A * 10/1966 Pankert ..... A47C 20/08 5/618
3,300,794 A * 1/1967 Altorfer ..... A61G 7/015 5/616
3,305,877 A * 2/1967 Niclsen ..... A47C 20/08 297/65
3,306,659 A * 2/1967 Greiner ..... A47C 1/032 297/29
3,319,270 A * 5/1967 Greiner ..... A47C 17/68 297/29
3,349,877 A * 10/1967 Downs ..... A61G 7/015 477/8
3,447,170 A * 6/1969 Spitz ..... A47C 23/005 297/452.17
3,593,350 A * 7/1971 Knight ..... A47C 20/041 5/616
3,644,946 A * 2/1972 Swatt ..... A61G 7/015 5/616

(56) References Cited

U.S. PATENT DOCUMENTS 3,656,191 A * 4/1972 Kjellberg ..... A47C 20/041 5/616
3,665,528 A * 5/1972 Kjellberg ..... A47C 20/041 5/618
3,681,792 A * 8/1972 Korber ..... A47C 20/041 5/154
3,711,876 A * 1/1973 Kirkland ..... A47C 20/08 5/610
3,781,623 A * 12/1973 Neumann ..... H01H 3/24 200/81.4
3,821,821 A * 7/1974 Burst ..... A61G 7/002 5/616
3,821,953 A * 7/1974 Mikan ..... A61G 7/015 606/245
3,916,461 A * 11/1975 Kerstholt ..... A47C 20/047 297/340
3,918,822 A * 11/1975 Rauschenberger .. A47C 20/043 16/365
3,921,230 A * 11/1975 Hanning ..... A47C 20/041 5/616
3,931,653 A * 1/1976 Bien ..... A47C 20/027 5/660
3,958,283 A * 5/1976 Adams ..... A61G 7/002 5/616
3,974,530 A * 8/1976 Lusch ..... F16B 12/54 5/618
4,095,296 A * 6/1978 Ferro ..... A61G 7/015 5/616
4,100,630 A * 7/1978 Klose ..... A47C 20/047 5/617
4,104,749 A * 8/1978 Grundler ..... A47C 20/041 5/616
4,120,057 A * 10/1978 Neumann ..... A47C 20/041 5/616
4,176,415 A * 12/1979 Dickerson ..... A47C 20/08 601/92
4,271,545 A * 6/1981 Christian, III ..... A47C 20/08 5/616
4,277,858 A * 7/1981 Bohme ..... A47C 20/047 5/191
4,346,489 A * 8/1982 McMullan ..... A47C 20/041 5/915
4,361,917 A * 12/1982 Wilson ..... A47C 20/08 5/616
4,371,996 A * 2/1983 Nahum ..... A47C 20/08 5/108
4,376,316 A * 3/1983 Mercier ..... A47C 20/041 5/616
4,381,571 A * 5/1983 Elliott ..... A61G 7/015 5/616
4,395,786 A * 8/1983 Casey ..... A61G 7/015 5/616
4,398,313 A * 8/1983 Mitchell ..... A47C 20/042 5/616
4,403,357 A * 9/1983 Degen ..... A47C 20/08 5/618
4,406,027 A * 9/1983 Bourda ..... A47C 20/047 5/17
4,458,370 A * 7/1984 Fickler ..... A47C 20/041 5/660
4,488,322 A * 12/1984 Hunt ..... A47C 27/10 5/713
4,494,259 A * 1/1985 Miller ..... A47C 20/08 5/616
4,499,618 A * 2/1985 Werner ..... A61G 7/002 192/48.8
4,573,226 A * 3/1986 Wittmann ..... A47C 23/064 5/236.1
4,589,151 A * 5/1986 Behrens ..... A47C 23/06 5/616
4,628,556 A * 12/1986 Blackman ..... A47C 20/041 248/550
4,633,539 A * 1/1987 Morrison ..... A47C 20/041 5/660
4,651,365 A * 3/1987 Zeigler ..... A47C 20/046 5/660
4,654,903 A * 4/1987 Chubb ..... A61G 7/1032 5/607
4,675,926 A * 6/1987 Lindblom ..... A61G 7/002 74/606 R
4,679,849 A * 7/1987 Torgny ..... A61G 5/006 5/619
4,685,159 A * 8/1987 Oetiker ..... A61G 7/02 5/616
4,685,160 A * 8/1987 Rizzardo ..... A61G 7/015 5/285
4,715,073 A * 12/1987 Butler ..... A61G 7/005 5/607
4,742,586 A * 5/1988 Galumbeck ..... A61G 7/015 5/722
4,785,487 A * 11/1988 Toran ..... A47C 19/045 5/616
4,821,351 A * 4/1989 Bergenwall ..... A47C 20/08 5/618
4,853,990 A * 8/1989 Elder ..... A47C 20/041 5/634
4,899,404 A * 2/1990 Galumbeck ..... A47C 20/04 5/616
4,928,332 A * 5/1990 Ogden ..... A47C 20/048 5/618
4,944,055 A * 7/1990 Shainfeld ..... A47C 20/08 5/619
4,961,236 A * 10/1990 Luconi ..... A61G 7/002 5/616
4,970,737 A * 11/1990 Sagel ..... A47C 20/08 5/616
4,992,784 A * 2/1991 Ruttiger ..... A47C 31/008 340/9.1
4,996,731 A * 3/1991 Kruyt ..... A47C 20/041 5/618
5,040,253 A * 8/1991 Cheng ..... A61G 7/015 5/616
5,063,623 A * 11/1991 Bathrick ..... A61G 7/015 5/616
5,075,911 A * 12/1991 Dewert ..... A47C 20/041 5/616
5,090,071 A * 2/1992 Bathrick ..... A47C 19/122 5/174
5,095,562 A * 3/1992 Alexander ..... A47C 20/041 5/619
5,105,486 A * 4/1992 Peterson ..... A61G 7/0528 5/618
5,105,487 A * 4/1992 Hakamiun ..... A61G 7/05746 5/633
5,155,881 A * 10/1992 Lafferty ..... A47C 23/15 5/189
5,161,274 A * 11/1992 Hayes ..... A47C 20/08 5/616
5,173,975 A * 12/1992 Peterson ..... A61G 7/0528 5/430
5,205,004 A * 4/1993 Hayes ..... A61G 7/015 5/618
5,255,403 A * 10/1993 Ortiz ..... A47C 20/041 5/503.1
5,269,031 A * 12/1993 Alexander ..... A47C 20/041 5/616
5,305,482 A * 4/1994 Dewert ..... A47C 20/041 5/616
5,311,625 A * 5/1994 Barker ..... A47C 31/008 417/363
5,315,726 A * 5/1994 Borenstein ..... A47C 20/041 5/507.1
5,329,657 A * 7/1994 Bartley ..... A47C 20/041 5/616
5,381,570 A * 1/1995 Cheng ..... F16B 12/28 16/329
5,404,604 A * 4/1995 Has ..... A47C 20/041 5/617

(56) References Cited

U.S. PATENT DOCUMENTS 5,481,769 A * 1/1996 Schneider ..... A47C 20/041 5/616
5,490,298 A * 2/1996 Goldsmith ..... A47C 19/045 5/613
5,528,449 A * 6/1996 Koch ..... H02H 3/12 307/140
5,537,701 A * 7/1996 Elliott ..... A61G 7/015 5/616
5,542,151 A * 8/1996 Stranski ..... A47D 13/063 16/329
5,542,744 A * 8/1996 Bathrick ..... A47C 20/041 74/89.41
5,544,375 A * 8/1996 Urness ..... A47C 20/041 5/616
5,544,376 A * 8/1996 Fromson ..... A47C 31/008 5/915
5,568,661 A * 10/1996 Bathrick ..... A47C 20/041 5/616
5,577,278 A * 11/1996 Barker ..... A47C 20/027 297/DIG. 10
5,579,550 A * 12/1996 Bathrick ..... A47C 19/005 5/618
5,608,932 A * 3/1997 Hasegawa ..... A47C 20/041 5/616
5,640,730 A * 6/1997 Godette ..... A47C 20/041 5/617
5,675,849 A * 10/1997 Koch ..... A47C 20/041 5/616
5,787,528 A * 8/1998 Antinori ..... A61G 7/018 5/915
5,791,001 A * 8/1998 Wang ..... A47C 27/001 5/942
5,829,077 A * 11/1998 Neige ..... A47C 20/041 5/616
5,901,610 A * 5/1999 Schneider ..... A47C 20/041 74/89.41
5,926,877 A * 7/1999 Lin ..... A61G 7/015 5/616
5,927,144 A * 7/1999 Koch ..... F16H 25/20 74/89.36
5,937,459 A * 8/1999 Binaghi ..... A47C 20/041 254/102
5,940,911 A * 8/1999 Wang ..... A47C 19/045 5/147
5,940,914 A * 8/1999 Robbins ..... A47C 20/08 5/915
6,000,076 A * 12/1999 Webster ..... A61G 7/05 5/616
6,000,077 A * 12/1999 Cyr ..... A47C 20/041 74/665 F
6,006,379 A * 12/1999 Hensley ..... A47C 20/08 5/915
6,061,852 A * 5/2000 Bathrick ..... A61G 7/015 5/618
6,065,727 A * 5/2000 Fitzgerald ..... A47C 20/041 248/302
6,070,935 A * 6/2000 Heimann ..... A47C 20/041 297/354.13
6,073,286 A * 6/2000 Wu ..... A47C 20/041 5/616
6,076,210 A * 6/2000 Wu ..... A61G 7/015 5/174
6,079,065 A * 6/2000 Luff ..... A47C 27/082 5/616
6,088,853 A * 7/2000 Jansen ..... A61G 7/015 5/616
6,101,647 A * 8/2000 Stroud ..... A47C 20/041 5/915
6,101,649 A * 8/2000 Wu ..... A47C 20/08 5/616
6,105,187 A * 8/2000 Gnjatovic ..... A61G 7/07 5/616
6,106,576 A * 8/2000 Fromson ..... A61H 1/00 318/16
6,108,839 A * 8/2000 Wu ..... A47C 20/08 5/174
6,138,303 A * 10/2000 Alvestad ..... A47C 20/08 5/613
6,158,808 A * 12/2000 Margolis ..... A47C 1/025 297/423.35
6,163,904 A * 12/2000 Royston ..... A47C 20/08 5/616
6,201,481 B1 * 3/2001 Bellingroth ..... A47C 20/041 5/616
6,209,157 B1 * 4/2001 Hensley ..... A47C 20/041 5/613
6,212,713 B1 * 4/2001 Kuck ..... A61G 15/02 297/411.39
6,216,295 B1 * 4/2001 Pearson ..... A61G 7/002 5/616
6,230,346 B1 * 5/2001 Branson ..... A61G 7/015 5/616
6,240,800 B1 * 6/2001 Bokamper ..... A47C 20/041 74/500
6,246,191 B1 * 6/2001 Bokamper ..... H02K 7/06 192/48.8
6,247,753 B1 * 6/2001 Alvestad ..... A47C 20/08 297/354.13
6,269,707 B1 * 8/2001 Koch ..... A47C 20/041 5/616
6,276,011 B1 * 8/2001 Antinori ..... A47C 20/041 5/613
6,300,732 B1 * 10/2001 Brambilla ..... A47C 20/041 318/7
6,343,392 B1 * 2/2002 Becker ..... A47C 20/041 5/616
6,377,010 B1 * 4/2002 Roither ..... A47B 9/10 318/560
6,393,641 B1 * 5/2002 Hensley ..... A47C 20/08 5/616
6,452,293 B1 * 9/2002 Roither ..... A47C 20/041 310/12.32
6,494,538 B1 * 12/2002 Alvestad ..... A47C 20/08 297/316
6,499,162 B1 * 12/2002 Lu ..... A47C 20/08 5/616
6,502,264 B1 * 1/2003 Clothier ..... A47C 21/006 5/915
6,513,398 B1 * 2/2003 Finkemeyer ..... H02K 7/06 74/427
6,513,790 B1 * 2/2003 Roither ..... H02K 7/06 254/98
6,516,479 B1 * 2/2003 Barbour ..... A61G 7/015 5/152
6,614,199 B1 * 9/2003 Bokamper ..... A47C 20/041 361/170
6,623,077 B1 * 9/2003 Piaulet ..... A47C 20/041 297/362.11
6,679,556 B1 * 1/2004 Alvestad ..... A47C 20/08 297/354.13
6,687,932 B1 * 2/2004 Bangert ..... A47C 20/041 5/617
6,739,004 B1 * 5/2004 Abrahamsen ..... A47C 20/041 74/425
6,877,816 B1 * 4/2005 Farmont ..... A47C 31/126 297/380
6,986,180 B1 * 1/2006 Wilke ..... A47C 20/08 5/613
7,146,662 B1 * 12/2006 Pollard ..... A47B 91/16 5/118
7,237,286 B1 * 7/2007 Kim ..... A61G 7/001 5/613
7,240,385 B1 * 7/2007 Brown ..... A47C 20/041 5/660
7,293,309 B1 * 11/2007 Shih ..... A47C 20/041 5/618
7,321,811 B1 * 1/2008 Rawls-Meehan ..... H04W 4/80 5/616

(56) References Cited

U.S. PATENT DOCUMENTS 8,347,433 B1 * 1/2013 Shih ..... A47C 20/041 5/613
8,387,180 B1 * 3/2013 Rizzardo ..... A47C 20/08 5/618
8,997,281 B2 * 4/2015 Daley ..... A61G 13/129 5/616
9,125,776 B1 * 9/2015 Shih ..... A61G 7/018
9,282,827 B1 * 3/2016 Lu ..... A47C 20/041
9,795,223 B1 * 10/2017 Shih ..... A61G 7/018
9,820,583 B1 * 11/2017 Gu ..... H02S 40/38
10,051,970 B1 * 8/2018 Kramer ..... A47C 20/041
10,111,530 B1 * 10/2018 Kramer ..... A47C 19/02
10,463,163 B1 * 11/2019 Aramli ..... A47C 21/026
10,729,253 B1 * 8/2020 Gaunt ..... A47C 27/10
10,905,249 B1 * 2/2021 Saghiri ..... A61B 5/6892
10,912,390 B1 * 2/2021 Chung ..... A47C 19/04
10,925,409 B1 * 2/2021 Aramli ..... A47C 21/06
11,382,534 B1 * 7/2022 Kahn ..... A61B 5/7267
11,701,287 B1 * 7/2023 Lindstrom ..... A61H 1/0222 602/33
11,918,119 B2 * 3/2024 Karschnik ..... A47C 21/048
11,930,932 B2 * 3/2024 Freelend ..... A47C 19/045
11,930,933 B2 * 3/2024 Stokesbary ..... A47C 20/041
11,930,934 B2 * 3/2024 Karschnik ..... A47C 27/082
2001/0013715 A1 * 8/2001 Schunke ..... A47C 20/041 297/85 M
2001/0032363 A1 * 10/2001 Elliott ..... A47C 20/08 5/618
2001/0044959 A1 * 11/2001 Davis ..... B60N 2/39 5/118
2002/0002743 A1 * 1/2002 Hartmann ..... A47C 20/08 5/613
2002/0036421 A1 * 3/2002 Bangert ..... A47C 20/08 297/316
2002/0066325 A1 * 6/2002 Roither ..... H02K 7/1166 74/425
2002/0144350 A1 * 10/2002 Shih ..... A61G 7/005 5/616
2002/0152552 A1 * 10/2002 Dewert ..... A47C 27/20 5/722
2002/0162170 A1 * 11/2002 Dewert ..... A47C 20/041 5/616
2003/0006869 A1 * 1/2003 Roither ..... H02K 11/40 335/220
2003/0011225 A1 * 1/2003 Barcesat ..... A47C 20/041 297/217.3
2003/0024338 A1 * 2/2003 Roither ..... H02K 7/06 74/425
2003/0052238 A1 * 3/2003 Schneider ..... A47C 20/08 248/421
2003/0079290 A1 * 5/2003 Dewert ..... A47C 20/041 5/618
2003/0101837 A1 * 6/2003 Abrahamsen ..... A47C 20/041 74/423
2003/0172756 A1 * 9/2003 Dewert ..... A47C 20/041 74/89.23
2003/0177580 A1 * 9/2003 Nagaoka ..... A61G 7/015 5/618
2003/0208845 A1 * 11/2003 Heaton ..... A47C 20/08 5/618
2003/0221258 A1 * 12/2003 Nagaoka ..... A47C 20/08 318/460
2004/0010850 A1 * 1/2004 Nagaoka ..... A61G 7/018 5/618
2004/0010851 A1 * 1/2004 Nagaoka ..... A47C 20/08 5/618
2004/0015320 A1 * 1/2004 Nagaoka ..... A47C 20/08 702/150
2004/0015321 A1 * 1/2004 Nagaoka ..... A47C 20/08 702/150
2004/0015322 A1 * 1/2004 Nagaoka ..... A47C 20/041 702/150
2004/0016056 A1 * 1/2004 Nagaoka ..... A47C 20/041 5/618
2004/0020316 A1 * 2/2004 Dewert ..... A47C 20/041 74/89.23
2004/0034934 A1 * 2/2004 Weinman ..... A61G 7/015 5/618
2004/0064891 A1 * 4/2004 Horitani ..... A47C 20/08 5/618
2004/0093969 A1 * 5/2004 Nielsen ..... A47C 20/041 74/89.23
2004/0103476 A1 * 6/2004 Barcesat ..... A47C 20/041 5/617
2004/0108192 A1 * 6/2004 Schneider ..... A47C 31/008 200/296
2004/0133982 A1 * 7/2004 Horitani ..... A61G 7/018 5/616
2004/0148704 A1 * 8/2004 Tekulve ..... A61G 7/015 5/618
2004/0169408 A1 * 9/2004 Dewert ..... A47C 20/041 297/285
2004/0169423 A1 * 9/2004 Ctvrtnicek ..... A47C 20/041 307/116
2004/0194213 A1 * 10/2004 Weinman ..... A47C 20/041 5/618
2004/0262587 A1 * 12/2004 Dewert ..... A47C 20/08 254/133 R
2005/0000020 A1 * 1/2005 Schermel ..... A47C 20/04 5/507.1
2005/0005357 A1 * 1/2005 Van Raemdonck ... A47C 20/08 5/617
2005/0011005 A1 * 1/2005 Borda ..... A47C 19/04 5/400
2005/0012477 A1 * 1/2005 Piana ..... A47C 31/008 318/109
2005/0015875 A1 * 1/2005 Dodgen ..... B60P 3/38 5/118
2005/0039263 A1 * 2/2005 Reed ..... A61G 7/015 5/618
2005/0055779 A1 * 3/2005 Damewood ..... A47C 27/001 5/722
2005/0061096 A1 * 3/2005 Dewert ..... A47C 20/041 74/421 A
2005/0120481 A1 * 6/2005 Farmont ..... A47C 20/041 5/613
2005/0206203 A1 * 9/2005 Piretti ..... A47C 1/143 297/75
2005/0210588 A1 * 9/2005 Loewenthal ..... A47C 20/041 5/618
2005/0251917 A1 * 11/2005 Wall ..... A47C 19/005 5/618
2006/0000021 A1 * 1/2006 Hayes ..... A47C 20/08 5/618
2006/0021137 A1 * 2/2006 Waldman ..... A47D 13/063 5/99.1
2006/0022500 A1 * 2/2006 Roither ..... A47C 20/041 297/362
2006/0026763 A1 * 2/2006 Mossbeck ..... A47C 20/041 5/616
2006/0085913 A1 * 4/2006 Kawakami ..... A47C 20/041 5/624
2006/0107462 A1 * 5/2006 Unger ..... A47C 20/041 5/618
2006/0130236 A1 * 6/2006 Dewert ..... A47C 1/0242 5/616
2006/0130342 A1 * 6/2006 Tewes ..... E21C 35/193 30/167
2006/0143827 A1 * 7/2006 Wilming ..... A47C 20/08 5/618
2006/0162078 A1 * 7/2006 Chang ..... A47C 27/081 5/616
2007/0067913 A1 * 3/2007 Dewert ..... A47C 20/08 5/618
2007/0113343 A1 * 5/2007 Jansen ..... A61G 7/015 5/618
2007/0157388 A1 * 7/2007 Mossbeck ..... A47C 20/041 5/618

(56) References Cited

U.S. PATENT DOCUMENTS

2007/0163046 A1* 7/2007 Eriksson ..... A47C 20/041 5/618
2007/0174968 A1* 8/2007 Barthelt ..... A61G 7/16 5/618
2007/0214571 A1* 9/2007 Piraino ..... A47C 27/065 5/616
2007/0220677 A1* 9/2007 Dewert ..... A47C 20/08 5/616
2007/0240263 A1* 10/2007 Kang ..... A47C 20/041 5/605
2007/0245489 A1* 10/2007 Boudreau ..... A47C 19/22 5/174
2007/0285035 A1* 12/2007 Roither ..... H02K 7/06 318/120
2008/0000027 A1* 1/2008 Clenet ..... A47C 20/041 5/200.1
2008/0012395 A1* 1/2008 Dewert ..... A47C 1/0242 297/83
2008/0028535 A1* 2/2008 Rodrigues Moreira ..... A47C 27/00 5/722
2008/0029103 A1* 2/2008 Regev ..... A47C 20/08 5/655
2008/0052830 A1* 3/2008 Koughan ..... A47C 19/005 5/660
2008/0073630 A1* 3/2008 Wu ..... H02K 16/00 254/1
2008/0098519 A1* 5/2008 Chen ..... A47C 7/38 5/47
2008/0121852 A1* 5/2008 Koch ..... H02K 7/06 254/100
2008/0127420 A1* 6/2008 Yang ..... A47C 20/041 5/617
2008/0178388 A1* 7/2008 Schermel ..... A47C 27/001 5/613
2008/0189862 A1* 8/2008 Matsuura ..... A47C 20/041 5/624
2008/0262657 A1* 10/2008 Howell ..... A47C 20/041 700/275
2008/0271246 A1* 11/2008 Nielsen ..... A47C 20/041 5/616
2008/0276373 A1* 11/2008 Clenet ..... A47C 21/026 5/618
2008/0276838 A1* 11/2008 Roleder ..... A47C 19/22 108/26
2008/0301877 A1* 12/2008 Crocker ..... A61G 7/012 5/643
2008/0309178 A1* 12/2008 Roither ..... A47C 20/041 310/77
2009/0012634 A1* 1/2009 Koch ..... A47B 9/00 108/20
2009/0019640 A1* 1/2009 Neuenswander ..... A61G 7/015 5/618
2009/0044340 A1* 2/2009 Nielsen ..... H02K 7/06 5/616
2009/0077748 A1* 3/2009 Kim ..... A61G 7/053 5/613
2009/0094748 A1* 4/2009 Long ..... A47C 20/041 5/613
2009/0100599 A1* 4/2009 Rawls-Meehan .... A47C 21/003 5/616
2009/0100951 A1* 4/2009 Frost ..... A47C 20/041 74/22 A
2009/0151074 A1* 6/2009 Nagaoka ..... A47C 20/08 5/616
2009/0151488 A1* 6/2009 Wang ..... A47C 20/041 74/89.32
2009/0178201 A1* 7/2009 Lujan ..... A61G 7/07 5/630
2009/0193587 A1* 8/2009 Neuenswander .... A47C 20/041 5/618
2009/0211028 A1* 8/2009 Richmond ..... A47C 20/08 5/717
2009/0235456 A1* 9/2009 Bock ..... A47C 20/08 5/616
2009/0267420 A1* 10/2009 Kristensen ..... H02H 3/12 307/126
2009/0301239 A1* 12/2009 Heinrichs ..... A47C 20/08 74/89.37
2010/0005590 A1* 1/2010 Jensen ..... F16H 57/01 310/83
2010/0038467 A1* 2/2010 Gassner ..... A47B 88/47 242/390.8
2010/0041484 A1* 2/2010 Gassner ..... A47C 20/041 464/106
2010/0056965 A1* 3/2010 Yeh ..... A47C 21/006 310/80
2010/0064830 A1* 3/2010 Zeng ..... F16C 29/02 74/89.33
2010/0132117 A1* 6/2010 Westermann ..... A61B 5/1115 600/595
2010/0139428 A1* 6/2010 Roither ..... A47C 20/041 74/89.33
2010/0170356 A1* 7/2010 Schmid ..... A47C 20/041 74/89.14
2010/0186168 A1* 7/2010 Harrison ..... A47C 20/041 5/616
2010/0199432 A1* 8/2010 Rawls-Meehan .... A47C 20/041 5/617
2010/0218625 A1* 9/2010 Baumeister ..... A47C 20/041 74/63
2010/0224017 A1* 9/2010 Nielsen ..... A47C 20/08 74/89.23
2010/0229303 A1* 9/2010 Goldsmith ..... A47C 19/005 5/285
2010/0231421 A1* 9/2010 Rawls-Meehan .... A47C 21/003 341/20
2010/0287704 A1* 11/2010 Hibler ..... A61H 23/0254 5/613
2010/0313690 A1* 12/2010 Nielsen ..... A47C 20/041 74/102
2010/0325799 A1* 12/2010 Huang ..... A47C 20/041 5/616
2010/0325800 A1* 12/2010 Huang ..... A47C 19/022 5/616
2011/0025150 A1* 2/2011 Heinrichs ..... A47C 20/042 310/83
2011/0037425 A1* 2/2011 Gehrke ..... G01R 31/34 702/177
2011/0094032 A1* 4/2011 Shih ..... A47C 20/041 5/616
2011/0245979 A1* 10/2011 Koch ..... A47C 31/008 700/275
2011/0247141 A1* 10/2011 Poulos ..... A47C 20/041 5/658
2011/0247144 A1* 10/2011 Oh ..... A47C 20/041 5/737
2011/0271446 A1* 11/2011 Shih ..... A47C 20/041 5/174
2012/0005828 A1* 1/2012 McCullar ..... A47C 20/041 307/147
2012/0054963 A1* 3/2012 Dewert ..... A47C 20/08 5/652
2012/0060287 A1* 3/2012 Dewert ..... A47C 20/08 5/600
2012/0060288 A1* 3/2012 Dewert ..... A47C 20/08 5/600
2012/0060289 A1* 3/2012 Dewert ..... A47C 20/08 5/656
2012/0096645 A1* 4/2012 Shih ..... A47C 20/041 5/616
2012/0138067 A1* 6/2012 Rawls-Meehan .... A61G 7/0514 5/616
2012/0193946 A1* 8/2012 Robertson ..... A47C 1/035 5/613
2012/0194106 A1* 8/2012 Hille ..... A47C 20/041 318/3

(56) References Cited

U.S. PATENT DOCUMENTS

2012/0205951 A1* 8/2012 Strolka-Echols ..... A47C 21/06 297/217.3
2012/0240337 A1* 9/2012 Shih ..... A61G 7/015 5/616
2012/0240696 A1* 9/2012 Bastholm ..... A47C 20/041 74/89.38
2012/0297543 A1* 11/2012 Robertson ..... A47C 20/041 5/616
2013/0019407 A1* 1/2013 Sheppard ..... A47C 20/041 5/611
2013/0025066 A1* 1/2013 Shih ..... A47C 21/006 5/694
2013/0074257 A1* 3/2013 Mendes ..... F16C 11/10 16/349
2013/0145553 A1* 6/2013 Shih ..... A61G 7/015 5/624
2013/0147250 A1* 6/2013 Kim ..... B60N 2/12 297/353
2013/0174343 A1* 7/2013 Chacon ..... G01B 7/003 5/613
2013/0191993 A1* 8/2013 Rawls-Meehan ..... A61G 7/018 5/617
2013/0207585 A1* 8/2013 Hille ..... A47C 20/041 318/480
2013/0239324 A1* 9/2013 Mossbeck ..... A47C 20/041 29/428
2013/0276234 A1* 10/2013 Rawls-Meehan .... A47C 19/045 5/618
2013/0283531 A1* 10/2013 Rawls-Meehan ..... A61G 7/018 5/619
2013/0289770 A1* 10/2013 Rawls-Meehan .... A47C 20/041 700/275
2013/0300233 A1* 11/2013 Loley ..... H04M 1/72412 310/71
2014/0035395 A1* 2/2014 Marcantoni ..... A47C 20/041 310/12.27
2014/0041121 A1* 2/2014 Shan ..... A47C 21/006 5/618
2014/0053340 A1* 2/2014 Viberg ..... A47C 20/04 5/657
2014/0059769 A1* 3/2014 Baker ..... A61G 7/015 5/613
2014/0101863 A1* 4/2014 Rohr ..... A47C 20/041 5/722
2014/0116168 A1* 5/2014 Viberg ..... A47C 20/041 74/105
2014/0123391 A1* 5/2014 Shan ..... A61G 7/015 5/616
2014/0152068 A1* 6/2014 Hille ..... H02P 4/00 310/83
2014/0159410 A1* 6/2014 Rasmussen ..... B60P 3/39 296/24.33
2014/0159618 A1* 6/2014 Hille ..... H02P 29/10 318/15
2014/0201915 A1* 7/2014 Ermalovich ..... A61G 7/0508 29/434
2014/0201916 A1* 7/2014 Ermalovich ..... A61G 7/015 5/617
2014/0203608 A1* 7/2014 Phillips ..... A47C 15/008 297/313
2014/0250600 A1* 9/2014 McCarty ..... A47C 20/041 5/617
2014/0257571 A1* 9/2014 Chen ..... A47C 31/008 700/275
2014/0259396 A1* 9/2014 McCarty ..... A47C 20/041 5/400
2014/0259397 A1* 9/2014 McReynolds ..... F16C 11/04 403/119
2014/0259409 A1* 9/2014 Shih ..... A61G 7/002 5/600
2014/0259419 A1* 9/2014 Stusynski ..... A47C 20/041 5/613
2014/0303786 A1* 10/2014 Langejurgen ..... G05B 15/02 700/275
2014/0304916 A1* 10/2014 Guo ..... A47C 20/041 5/616
2014/0311265 A1* 10/2014 Duck ..... A61G 7/018 74/89.23
2014/0312725 A1* 10/2014 Oberndorfer ..... A47C 20/041 310/80
2014/0319892 A1* 10/2014 Boccara ..... A47C 20/041 297/391
2014/0325759 A1* 11/2014 Bly ..... A61G 7/015 5/613
2014/0345060 A1* 11/2014 Ribble ..... A61B 5/6892 5/706
2014/0352068 A1* 12/2014 Xu ..... A61G 7/015 5/616
2014/0366267 A1* 12/2014 Suh ..... A47C 20/041 5/174
2015/0019020 A1* 1/2015 Hille ..... G05B 15/02 700/275
2015/0025688 A1* 1/2015 Hille ..... A47C 31/008 700/275
2015/0026890 A1* 1/2015 Hille ..... A47C 20/041 5/613
2015/0033885 A1* 2/2015 Kristen ..... F16H 25/20 74/89.23
2015/0035457 A1* 2/2015 Hille ..... A47C 20/08 318/16
2015/0040317 A1* 2/2015 Sheppard ..... A47C 19/045 5/611
2015/0048763 A1* 2/2015 Hille ..... A47C 31/008 318/16
2015/0054429 A1* 2/2015 Hille ..... H02P 7/18 318/283
2015/0067965 A1* 3/2015 Xu ..... A61G 7/018 5/616
2015/0074908 A1* 3/2015 Dewert ..... A47C 20/08 5/616
2015/0107024 A1* 4/2015 Xu ..... A47C 20/041 5/616
2015/0121623 A1* 5/2015 Huang ..... A61G 7/018 5/616
2015/0123772 A1* 5/2015 Hille ..... A47C 20/041 340/12.5
2015/0135865 A1* 5/2015 Oberndorfer ..... F16H 25/2025 74/89.14
2015/0143934 A1* 5/2015 Wu ..... A47C 20/041 74/89.29
2015/0171703 A1* 6/2015 Viberg ..... H02K 7/1166 310/83
2015/0182397 A1* 7/2015 Palashewski ..... A47C 27/081 5/616
2015/0182399 A1* 7/2015 Rose ..... A47C 20/041 5/710
2015/0196443 A1* 7/2015 Tarquinio ..... A47C 21/00 5/613
2015/0272816 A1* 10/2015 Zhang ..... A47C 23/00 601/52
2015/0289665 A1* 10/2015 Klimm ..... F16H 19/04 74/89.17
2015/0290059 A1* 10/2015 Brosnan ..... A47C 20/041 5/616
2015/0297431 A1* 10/2015 Rawls-Meehan ..... A61G 7/05769 5/613
2015/0305510 A1* 10/2015 Tarplee ..... A47C 20/041 601/57
2015/0305517 A1* 10/2015 Koch ..... A47C 31/008 700/275
2015/0313369 A1* 11/2015 Tarplee ..... A61H 23/0254 601/57
2015/0313779 A1* 11/2015 Kume ..... A61G 7/012 5/616
2015/0327687 A1* 11/2015 Chacon ..... G01V 3/088 700/275

(56) References Cited

U.S. PATENT DOCUMENTS

2015/0328070 A1* 11/2015 Tarplee ..... A61H 23/0254 5/616
2015/0342363 A1* 12/2015 Lin ..... A47C 1/03211 297/217.3
2015/0354679 A1* 12/2015 Oberndörfer ..... A61C 8/0068 74/89.23
2016/0015583 A1* 1/2016 Dewert ..... A47C 19/12 5/616
2016/0037936 A1* 2/2016 Nomura ..... A47C 20/08 5/617
2016/0037937 A1* 2/2016 Dewert ..... A47C 1/0242 5/616
2016/0047446 A1* 2/2016 Hung ..... A47B 9/04 74/89.35
2016/0058639 A1* 3/2016 Lacasse ..... A61G 7/018 5/618
2016/0067127 A1* 3/2016 Shimada ..... A61G 7/018 700/275
2016/0081866 A1* 3/2016 Hille ..... A61G 7/018 700/275
2016/0084487 A1* 3/2016 Chacon ..... H05B 47/115 315/297
2016/0113410 A1* 4/2016 Ermalovich ..... A47C 21/006 248/316.6
2016/0120716 A1* 5/2016 Ribble ..... A61G 7/015 5/616
2016/0120719 A1* 5/2016 Bellingroth ..... A47C 20/041 74/99 R
2016/0120740 A1* 5/2016 Rawls-Meehan .... A47C 31/008 601/49
2016/0128883 A1* 5/2016 Robertson ..... A47C 1/035 5/613
2016/0157623 A1* 6/2016 Dewert ..... A47C 17/16 5/616
2016/0161623 A1* 6/2016 Chacon ..... A47C 20/041 324/658
2016/0206113 A1* 7/2016 Rawls-Meehan .... A47C 20/048
2016/0206486 A1* 7/2016 Eskridge, III ..... A47C 20/041
2016/0206487 A1* 7/2016 Loewen ..... A47C 20/04
2016/0206488 A1* 7/2016 Bellingroth ..... A61G 7/0755
2016/0235207 A1* 8/2016 Koch ..... A47C 7/58
2016/0242558 A1* 8/2016 Rawls-Meehan ..... A61G 7/018
2016/0262549 A1* 9/2016 Rawls-Meehan ..... A47C 20/04
2016/0278534 A1* 9/2016 Rawls-Meehan .... A47C 20/041
2016/0286970 A1* 10/2016 Robertson ..... A47C 20/04
2016/0286974 A1* 10/2016 Boyd ..... A61F 5/56
2016/0316919 A1* 11/2016 Goldsmith ..... A47C 19/025
2016/0331145 A1* 11/2016 Baumeister ..... A47C 7/402
2016/0331612 A1* 11/2016 Clenet ..... A47C 20/08
2016/0338890 A1* 11/2016 Chiang ..... G05B 15/02
2016/0374880 A1* 12/2016 Fisher ..... A61G 7/018 5/618
2016/0377273 A1* 12/2016 Hille ..... A47C 31/00 307/38
2017/0007030 A1* 1/2017 Gopalakrishnan ... A47C 20/041
2017/0007033 A1* 1/2017 Gopalakrishnan ..... A47C 17/86
2017/0042340 A1* 2/2017 Chacon ..... A47C 7/62
2017/0047874 A1* 2/2017 Shih ..... H02P 7/2855
2017/0055720 A1* 3/2017 Lin ..... A47C 20/041
2017/0071356 A1* 3/2017 Xu ..... A47C 20/041
2017/0100277 A1* 4/2017 Ke ..... A61F 5/56
2017/0112716 A1* 4/2017 Rawls-Meehan ..... A61H 23/0263
2017/0127844 A1* 5/2017 Grone ..... A47C 7/402
2017/0135883 A1* 5/2017 Franceschetti ..... G05B 19/042
2017/0202360 A1* 7/2017 Sherman ..... A47C 20/04
2017/0208953 A1* 7/2017 Shih ..... A47C 20/041
2017/0208956 A1* 7/2017 Rawls-Meehan .... A47C 20/041
2017/0221350 A1* 8/2017 Hille ..... A47C 31/008
2017/0224121 A1* 8/2017 Abraham ..... A61G 7/015
2017/0230357 A1* 8/2017 Canfield ..... G06F 21/31
2017/0238716 A1* 8/2017 Kramer ..... A47C 20/08
2017/0251818 A1* 9/2017 Andersen ..... A47C 20/041
2017/0252241 A1* 9/2017 Furman ..... A61G 5/1056
2017/0252244 A1* 9/2017 Zhou ..... A61G 7/018
2017/0258239 A1* 9/2017 Xie ..... A47C 27/002
2017/0258240 A1* 9/2017 Andersen ..... A47C 20/041
2017/0280882 A1* 10/2017 Shih ..... F16B 12/56
2017/0295943 A1* 10/2017 Barr ..... A47C 19/025
2017/0295948 A1* 10/2017 Awshee ..... A47C 21/08
2017/0311728 A1* 11/2017 Hille ..... A61G 7/015
2017/0312155 A1* 11/2017 Copetti ..... A47C 20/041
2017/0318977 A1* 11/2017 Rawls-Meehan .... A47C 20/041
2017/0318979 A1* 11/2017 Rawls-Meehan ..... A47C 27/14
2017/0318982 A1* 11/2017 Campbell ..... H02J 50/10
2017/0325592 A1* 11/2017 Suh ..... A47C 17/04
2017/0332798 A1* 11/2017 Dewert ..... A47C 20/041
2017/0332800 A1* 11/2017 Dewert ..... A61G 7/018
2017/0333271 A1* 11/2017 Kramer ..... A47C 20/041
2017/0347806 A1* 12/2017 Shih ..... A47C 20/041
2017/0347807 A1* 12/2017 Totemeier ..... A47C 19/005
2017/0354265 A1* 12/2017 Kramer ..... A61H 23/00
2017/0360209 A1* 12/2017 Zhou ..... A47C 20/041
2017/0360212 A1* 12/2017 Rawls-Meehan ..... A47C 27/14
2018/0000253 A1* 1/2018 Bellingroth ..... A47C 3/00
2018/0008049 A1* 1/2018 Shih ..... A47C 19/021
2018/0014656 A1* 1/2018 Guohong ..... A47C 19/025
2018/0027979 A1* 2/2018 Zhao ..... A47C 7/38
2018/0027980 A1* 2/2018 Kramer ..... A47C 19/021
2018/0042392 A1* 2/2018 Brown ..... A47C 20/12
2018/0049556 A1* 2/2018 Huang ..... A47C 17/80
2018/0064259 A1* 3/2018 Shih ..... A47C 20/08
2018/0064260 A1* 3/2018 Shih ..... A47C 20/08
2018/0084921 A1* 3/2018 Huang ..... G03B 21/64
2018/0098638 A1* 4/2018 Lo ..... A47C 21/06
2018/0103770 A1* 4/2018 Nava ..... A47C 19/02
2018/0110340 A1* 4/2018 Rawls-Meehan .... A47C 20/041
2018/0110665 A1* 4/2018 Totemeier ..... A47C 20/041
2018/0112750 A1* 4/2018 Klimm ..... F16H 57/03
2018/0125249 A1* 5/2018 Chung ..... A47C 19/021
2018/0125250 A1* 5/2018 Dewert ..... A47C 20/041
2018/0125251 A1* 5/2018 Dewert ..... A47C 20/041
2018/0125252 A1* 5/2018 Chung ..... A47C 20/04
2018/0125260 A1* 5/2018 Peterson ..... A47C 27/10
2018/0125261 A1* 5/2018 Neudecker ..... A47C 23/067
2018/0132625 A1* 5/2018 Bellingroth ..... A47C 20/041
2018/0132626 A1* 5/2018 He ..... A47C 20/041
2018/0133082 A1* 5/2018 King ..... A61G 13/06
2018/0168358 A1* 6/2018 Dewert ..... A47C 20/041
2018/0168359 A1* 6/2018 Moon ..... A47C 20/08
2018/0177304 A1* 6/2018 Fei ..... A47C 20/041
2018/0235373 A1* 8/2018 Tsai ..... A47C 20/08
2018/0242751 A1* 8/2018 MacNaughton ..... A47C 20/042
2018/0256423 A1* 9/2018 Kramer ..... A61G 7/018
2018/0271297 A1* 9/2018 Dewert ..... A61G 7/018
2018/0271298 A1* 9/2018 Alletto, Jr. ..... A47C 20/08
2018/0280218 A1* 10/2018 Yamaji ..... A61B 5/0507
2018/0289175 A1* 10/2018 Lukas ..... A47C 31/008
2018/0296001 A1* 10/2018 Tucker ..... A47C 17/12
2018/0303244 A1* 10/2018 Dewert ..... A47C 31/008
2018/0325268 A1* 11/2018 Dewert ..... A47C 27/053
2018/0325269 A1* 11/2018 Viermann ..... A47C 20/041
2018/0325270 A1* 11/2018 Purser ..... A47C 20/041
2018/0338624 A1* 11/2018 Shan ..... A47C 20/041
2018/0338625 A1* 11/2018 Nava ..... A47C 19/021
2018/0338626 A1* 11/2018 Shan ..... A47C 31/008
2018/0338725 A1* 11/2018 Shan ..... A61B 5/6892
2018/0342148 A1* 11/2018 Shan ..... A47C 17/86
2018/0360224 A1* 12/2018 Cimadamore ..... A47C 13/005
2018/0360226 A1* 12/2018 Dewert ..... B65D 85/07
2018/0368569 A1* 12/2018 Laing ..... A47B 17/02
2018/0368581 A1* 12/2018 He ..... A47C 20/041
2019/0000238 A1* 1/2019 Eskridge, III ..... A61G 7/07
2019/0008284 A1* 1/2019 Gehrke ..... A61G 7/015
2019/0014911 A1* 1/2019 Ribble ..... A47C 19/021
2019/0015244 A1* 1/2019 Ribble ..... A47C 20/04
2019/0015274 A1* 1/2019 Ribble ..... A61F 5/56
2019/0021507 A1* 1/2019 Shan ..... A47C 19/00
2019/0021509 A1* 1/2019 Shan ..... A47C 20/041
2019/0021510 A1* 1/2019 Gao ..... A47C 20/08
2019/0021511 A1* 1/2019 Shih ..... A47C 20/041
2019/0029434 A1* 1/2019 Platzer ..... A47C 31/003

(56) References Cited

U.S. PATENT DOCUMENTS

2019/0029436 A1* 1/2019 Lin ..... A47C 1/0325
2019/0059601 A1* 2/2019 Kramer ..... A47C 19/045
2019/0069682 A1* 3/2019 Liu ..... A47C 20/04
2019/0069683 A1* 3/2019 Gajjar ..... A47C 19/021
2019/0069687 A1* 3/2019 Liang ..... A47C 17/86
2019/0099007 A1* 4/2019 Ribble ..... A61G 7/015
2019/0099008 A1* 4/2019 Yin ..... A47C 23/34
2019/0116986 A1* 4/2019 Werner ..... A47C 19/12
2019/0117484 A1* 4/2019 Shih ..... A61G 7/05
2019/0125088 A1* 5/2019 Huang ..... A47C 19/005
2019/0133329 A1* 5/2019 Blom ..... A47C 20/08
2019/0133331 A1* 5/2019 Kramer ..... A47C 19/025
2019/0142177 A1* 5/2019 Brown ..... A47C 20/041 5/618
2019/0150626 A1* 5/2019 Huang ..... A47C 20/041
2019/0150627 A1* 5/2019 Wada ..... A61G 7/05
2019/0183239 A1* 6/2019 Semmelrath ..... A47C 20/08
2019/0183251 A1* 6/2019 Niederkofler ..... A61G 7/0527
2019/0191887 A1* 6/2019 Tsai ..... A47C 17/70
2019/0191890 A1* 6/2019 Huang ..... A47C 20/10
2019/0223607 A1* 7/2019 Ji ..... A47C 19/12
2019/0223608 A1* 7/2019 Ji ..... A47C 19/04
2019/0223609 A1* 7/2019 Sherman ..... A47C 27/14
2019/0223610 A1* 7/2019 Huai ..... A47C 19/005
2019/0231078 A1* 8/2019 Chung ..... A47C 19/025
2019/0231079 A1* 8/2019 Schulte ..... A47C 31/008
2019/0239652 A1* 8/2019 Chung ..... A47C 23/02
2019/0239653 A1* 8/2019 Shan ..... A47C 20/041
2019/0252902 A1* 8/2019 Koch ..... H02J 50/10
2019/0252903 A1* 8/2019 Lukas ..... H02J 50/20
2019/0254436 A1* 8/2019 Koltzenburg ..... A47C 20/041
2019/0257396 A1* 8/2019 Gassner ..... F16H 21/16
2019/0261778 A1* 8/2019 Lukas ..... G01S 7/497
2019/0298074 A1* 10/2019 Dan-On ..... A61G 7/018
2019/0298075 A1* 10/2019 Dan-On ..... A47C 20/08
2019/0307257 A1* 10/2019 Wittekind ..... A47C 20/048
2019/0307621 A1* 10/2019 Kim ..... A61G 7/005
2019/0313808 A1* 10/2019 Hille ..... A47C 20/041
2019/0328143 A1* 10/2019 Choi ..... A47C 20/18
2019/0328593 A1* 10/2019 Choi ..... A61G 7/018
2019/0343271 A1* 11/2019 Hille ..... A47C 1/03211
2019/0374039 A1* 12/2019 Hosokawa ..... A61G 13/02
2019/0378612 A1* 12/2019 Hosokawa ..... G06F 3/147
2020/0000242 A1* 1/2020 Ermalovich ..... F04D 29/601
2020/0000666 A1* 1/2020 Hille ..... A61G 12/00
2020/0014280 A1* 1/2020 Müller ..... F16D 49/02
2020/0022504 A1* 1/2020 Zhang ..... A47C 20/041
2020/0029700 A1* 1/2020 Bratl ..... A47C 20/041
2020/0029706 A1* 1/2020 Yao ..... A47C 31/003
2020/0037775 A1* 2/2020 Koch ..... A47C 20/041
2020/0039734 A1* 2/2020 Niederkofler ..... B65D 77/042
2020/0046133 A1* 2/2020 Huang ..... A47C 21/026
2020/0054145 A1* 2/2020 Shih ..... A47C 23/005
2020/0054148 A1* 2/2020 Zeng ..... A47C 19/005
2020/0060429 A1* 2/2020 Schulte ..... H01R 13/73
2020/0060908 A1* 2/2020 Hosokawa ..... A61G 7/05
2020/0069069 A1* 3/2020 Shih ..... A47C 31/023
2020/0078238 A1* 3/2020 Huang ..... A61G 7/012
2020/0093278 A1* 3/2020 Morrison ..... A47C 20/027
2020/0100596 A1* 4/2020 He ..... A47C 17/00
2020/0132175 A1* 4/2020 Knudsen ..... A47C 20/041
2020/0154888 A1* 5/2020 Brown ..... A47C 20/041
2020/0154899 A1* 5/2020 Brown ..... A47C 20/12
2020/0154901 A1* 5/2020 Yang ..... A47C 20/048
2020/0172142 A1* 6/2020 Young ..... B62B 7/142
2020/0178695 A1* 6/2020 Shih ..... A47C 20/041
2020/0178702 A1* 6/2020 Shiino ..... A61B 5/11
2020/0187662 A1* 6/2020 Zeng ..... A47C 19/122
2020/0187669 A1* 6/2020 Takaoka ..... A47C 27/122
2020/0205576 A1* 7/2020 Choi ..... A47C 20/041
2020/0214460 A1* 7/2020 Wang ..... A47C 21/006
2020/0214461 A1* 7/2020 Wang ..... A47C 20/08
2020/0214462 A1* 7/2020 Wang ..... A47C 19/122
2020/0214463 A1* 7/2020 Xie ..... A47C 20/041
2020/0221881 A1* 7/2020 Huang ..... A47C 19/025
2020/0221882 A1* 7/2020 Wang ..... A47C 21/044
2020/0237101 A1* 7/2020 Liu ..... A47C 20/041
2020/0237105 A1* 7/2020 Eskridge, III ..... A47C 27/14
2020/0253384 A1* 8/2020 Kubota ..... A47C 20/041
2020/0297124 A1* 9/2020 Schell ..... A61G 7/018
2020/0297125 A1* 9/2020 Weibel ..... A47C 20/041
2020/0328703 A1* 10/2020 Hille ..... H02P 7/0094
2020/0359806 A1* 11/2020 Wang ..... A47C 21/044
2020/0367660 A1* 11/2020 Tsai ..... A47C 20/04
2020/0375368 A1* 12/2020 Choi ..... A47C 20/04
2020/0383851 A1* 12/2020 Kleeberg ..... A61G 7/05
2020/0390246 A1* 12/2020 Chen ..... F16H 21/18
2020/0397147 A1* 12/2020 Ren ..... A47C 19/021
2020/0405068 A1* 12/2020 Oberle, Sr. ..... A61G 7/012
2021/0007502 A1* 1/2021 Zeng ..... A47C 21/006
2021/0018077 A1* 1/2021 Müller ..... F16H 25/20
2021/0022514 A1* 1/2021 Bellingroth ..... A47C 19/021
2021/0022516 A1* 1/2021 Bellingroth ..... A47C 20/041
2021/0022517 A1* 1/2021 Bellingroth ..... A47C 19/005
2021/0030161 A1* 2/2021 Henshaw ..... A47C 7/70
2021/0030164 A1* 2/2021 Müller ..... F16H 1/225
2021/0035555 A1* 2/2021 Hille ..... G05B 19/042
2021/0035580 A1* 2/2021 Hille ..... G10L 15/32
2021/0052081 A1* 2/2021 Sun ..... A47C 27/122
2021/0052085 A1* 2/2021 Wang ..... A47C 31/005
2021/0059422 A1* 3/2021 Wise ..... A47C 20/041
2021/0059423 A1* 3/2021 Lu ..... A47C 7/383
2021/0085547 A1* 3/2021 Kubota ..... A61G 7/018
2021/0100366 A1* 4/2021 Liu ..... A47C 31/123
2021/0120963 A1* 4/2021 Lin ..... A47C 20/04
2021/0121345 A1* 4/2021 Chung ..... A47C 20/041
2021/0154066 A1* 5/2021 Huang ..... A47C 19/045
2021/0177153 A1* 6/2021 Wang ..... A47C 19/04
2021/0186223 A1* 6/2021 Zeng ..... A47C 17/162
2021/0186230 A1* 6/2021 Kleeberg ..... A61G 7/015
2021/0204720 A1* 7/2021 Karschnik ..... A47C 27/14
2021/0215236 A1* 7/2021 Lukas ..... A47C 20/041
2021/0219735 A1* 7/2021 Huang ..... A47C 20/042
2021/0227977 A1* 7/2021 Weidhas ..... A47C 1/0325
2021/0251390 A1* 8/2021 Goldsmith ..... A47C 19/14
2021/0259431 A1* 8/2021 Wang ..... A47C 20/041
2021/0259432 A1* 8/2021 Wang ..... A47C 20/12
2021/0307531 A1* 10/2021 Lee ..... A61G 7/05
2021/0315755 A1* 10/2021 Matsubayashi ..... A61G 7/018
2021/0321785 A1* 10/2021 Wang ..... A47C 21/00
2021/0346219 A1* 11/2021 Shih ..... A61G 7/015
2021/0368993 A1* 12/2021 Wang ..... A47C 20/041
2021/0378411 A1* 12/2021 Xie ..... A47C 20/041
2021/0393042 A1* 12/2021 Shih ..... A47C 19/005
2021/0393043 A1* 12/2021 Wang ..... A47C 19/025
2022/0000269 A1* 1/2022 Shan ..... A47C 20/12
2022/0022659 A1* 1/2022 Chung ..... A47C 20/041
2022/0047087 A1* 2/2022 Dewert ..... A47C 20/041
2022/0047088 A1* 2/2022 Gramse ..... G06N 3/04
2022/0053942 A1* 2/2022 Holm ..... A47C 20/041
2022/0061542 A1* 3/2022 Bishop ..... A47C 20/041
2022/0087439 A1* 3/2022 Wang ..... A47C 20/041
2022/0087886 A1* 3/2022 Wolfe ..... A47C 20/041
2022/0095802 A1* 3/2022 Chen ..... A47C 20/041
2022/0095803 A1* 3/2022 Wang ..... A47C 20/041
2022/0104630 A1* 4/2022 Aramli ..... A47C 21/026
2022/0117400 A1* 4/2022 Zeng ..... A47C 19/12
2022/0117401 A1* 4/2022 Wang ..... A47C 21/006
2022/0117776 A1* 4/2022 Nishiura ..... G05B 15/02
2022/0133048 A1* 5/2022 Bellingroth ..... A47C 19/12 5/132
2022/0133049 A1* 5/2022 Bellingroth ..... A47C 20/04 5/131
2022/0160140 A1* 5/2022 Shih ..... A47C 20/041
2022/0167754 A1* 6/2022 Fukuyama ..... A61G 7/002
2022/0167755 A1* 6/2022 Fukuyama ..... A47C 17/80
2022/0168162 A1* 6/2022 Dewert ..... A47C 20/041
2022/0192388 A1* 6/2022 Smith ..... A47C 31/008
2022/0192906 A1* 6/2022 Hsu ..... A61G 7/012
2022/0202195 A1* 6/2022 Zheng ..... A47C 20/041
2022/0231580 A1* 7/2022 Porde ..... H02K 7/1166
2022/0232991 A1* 7/2022 Ermalovich ..... A47C 20/04
2022/0248861 A1* 8/2022 Shan ..... A47C 31/023
2022/0248862 A1* 8/2022 Liu ..... A47C 19/024

(56) References Cited

U.S. PATENT DOCUMENTS

2022/0248863 A1* 8/2022 Shan ..... A47C 20/041
2022/0248864 A1* 8/2022 Shan ..... A47C 19/122
2022/0257020 A1* 8/2022 Schlaich ..... A47C 20/041
2022/0287474 A1* 9/2022 Wang ..... A47C 20/04
2022/0304475 A1* 9/2022 Havaich ..... A47C 20/08
2022/0304476 A1* 9/2022 Liu ..... A47C 20/12
2022/0304478 A1* 9/2022 Wang ..... A47C 20/041
2022/0312980 A1* 10/2022 Shan ..... A47C 19/12
2022/0312985 A1* 10/2022 Wang ..... A47C 20/041
2022/0313514 A1* 10/2022 Kirtikar ..... A61G 7/015
2022/0330706 A1* 10/2022 Chen ..... A47C 20/041
2022/0338640 A1* 10/2022 Shan ..... A47C 31/008
2022/0354265 A1* 11/2022 Wang ..... A47C 19/122
2022/0354266 A1* 11/2022 Wang ..... A47C 19/122
2022/0361682 A1* 11/2022 Chen ..... A47C 20/041
2022/0369822 A1* 11/2022 Ma ..... A47C 19/122
2022/0369823 A1* 11/2022 Groppel ..... A47C 27/06
2022/0386783 A1* 12/2022 Schell ..... A47C 20/04
2023/0000257 A1* 1/2023 Che ..... A47C 20/041
2023/0000258 A1* 1/2023 Xiang ..... A61G 7/015
2023/0016845 A1* 1/2023 Hsu ..... A47C 20/04
2023/0017386 A1* 1/2023 Zannoni ..... H02P 7/05
2023/0021490 A1* 1/2023 Jian ..... A47C 20/041
2023/0025691 A1* 1/2023 Neuenswander ..... A47C 20/10
2023/0033335 A1* 2/2023 Wang ..... A47C 19/122
2023/0034676 A1* 2/2023 Wang ..... A47C 20/041
2023/0038349 A1* 2/2023 Shan ..... G10L 15/22
2023/0050413 A1* 2/2023 Chung ..... A47C 20/12
2023/0059520 A1* 2/2023 Scott ..... A47C 17/86
2023/0137120 A1* 5/2023 Kubota ..... A61B 5/024 5/616
2023/0165382 A1* 6/2023 Ermalovich ..... A47C 20/041 5/618
2023/0200546 A1* 6/2023 Shih ..... A47C 20/041 5/174
2023/0200549 A1* 6/2023 Shih ..... A47C 20/08 5/616
2023/0200550 A1* 6/2023 Wang ..... A47C 20/041 5/618
2023/0218087 A1* 7/2023 Werner ..... A47C 20/041 5/207
2023/0225518 A1* 7/2023 Huang ..... A47C 20/041 5/174
2023/0248154 A1* 8/2023 Ermalovich ..... A47C 21/026 5/613
2023/0270259 A1* 8/2023 Freelend ..... A47C 20/041 5/178
2023/0270260 A1* 8/2023 Dewert ..... A47C 20/041 5/657
2023/0309702 A1* 10/2023 Freelend ..... A47C 20/041 5/618
2023/0309703 A1* 10/2023 Freelend ..... A47C 19/045 5/616
2023/0346130 A1* 11/2023 Liechtenstein ..... A47C 20/041
2023/0355002 A1* 11/2023 Hill ..... A47C 20/041
2023/0355003 A1* 11/2023 Shih ..... A47C 20/041
2023/0363543 A1* 11/2023 Stokesbary ..... A47C 20/041
2023/0363544 A1* 11/2023 Stokesbary ..... A47C 19/045
2023/0381039 A1* 11/2023 Tokugi ..... A61B 5/4812
2023/0404271 A1* 12/2023 Ma ..... A47C 19/021
2023/0404273 A1* 12/2023 Ma ..... A47C 20/041
2023/0404275 A1* 12/2023 Wang ..... A47C 20/041
2023/0404276 A1* 12/2023 Choi ..... A47C 20/041
2024/0008652 A1* 1/2024 Wang ..... A47C 19/122
2024/0016302 A1* 1/2024 Brosnan ..... A47C 21/048
2024/0023720 A1* 1/2024 Shih ..... A47C 20/041
2024/0057779 A1* 2/2024 Koltzenburg ..... A47C 20/08
2024/0074592 A1* 3/2024 Gaunt ..... A47C 27/082

* cited by examiner

ELECTRIC BED

BACKGROUND OF THE INVENTION

1. Field of the Invention

The present invention relates generally to an electric bed and more particularly, to an electric bed having an adjustable support angle to a user's head.

2. Description of the Related Art

Conventional electric beds are usually provided with adjustable support angles to a user's head, back and legs in accordance with the user's needs, so that the user can lie or sit on the electric bed at a most comfortable angle. However, the swinging or rotational angles of parts of the conventional electric beds are usually designed in accordance with a basis that the user lies on the electric bed in a face-up manner without considering the user's need of lying on his/her stomach. As such, the conventional electric beds may not fulfil the needs of specific user groups, such as those with pressure ulcers on the back, those who are accustomed to sleeping on the stomach, or those who require massage on the back. In another aspect, many people suffer from snoring or sleep apnea. In fact, this phenomenon is related to the sleeping position. If the head can be adjusted to tilt upwardly and backwardly, the problem of snoring can be effectively relieved. However, as far as is known, there is currently no electric bed having a function that can support a user's head to a head-up manner, i.e., chin-up posture.

SUMMARY OF THE INVENTION

The present invention has been accomplished in view of the above-noted circumstances. It is an objective of the present invention to provide an electric bed, which can adjust a support angle to a user's head to enable the user to lie on his/her stomach comfortably.

It is another objective of the present invention to provide an electric bed, which can support a user in a head-up manner, thereby reliving snoring.

To attain the above objectives, the present invention provides an electric bed comprising a base, a back supporting unit, a first actuator, a head supporting unit, and a second actuator. The back supporting unit has an end pivotally connected with the base, and a top side provided with a back supporting surface. The first actuator has two ends respectively and pivotally connected with the base and the back supporting unit in a way that the back supporting unit is driven by the first actuator to upwardly and downwardly swing relative to the base. The head supporting unit has an end pivotally connected with the back supporting unit, and a top side provided with a head supporting surface. The second actuator has two ends respectively and pivotally connected with the back supporting unit and the head supporting unit in a way that the head supporting unit is driven by the second actuator to swing between an initial position and a head-up position relative to the back supporting unit. When the head supporting unit stays at the initial position, the head supporting surface is flush with the back supporting surface. The head-up position is lower than the initial position.

With the above-mentioned technical features, the electric bed of the present invention can change a support angle to a user's head to enable the user to lie on his/her stomach comfortably, and can support the user in a head-up manner, thereby relieving snoring.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
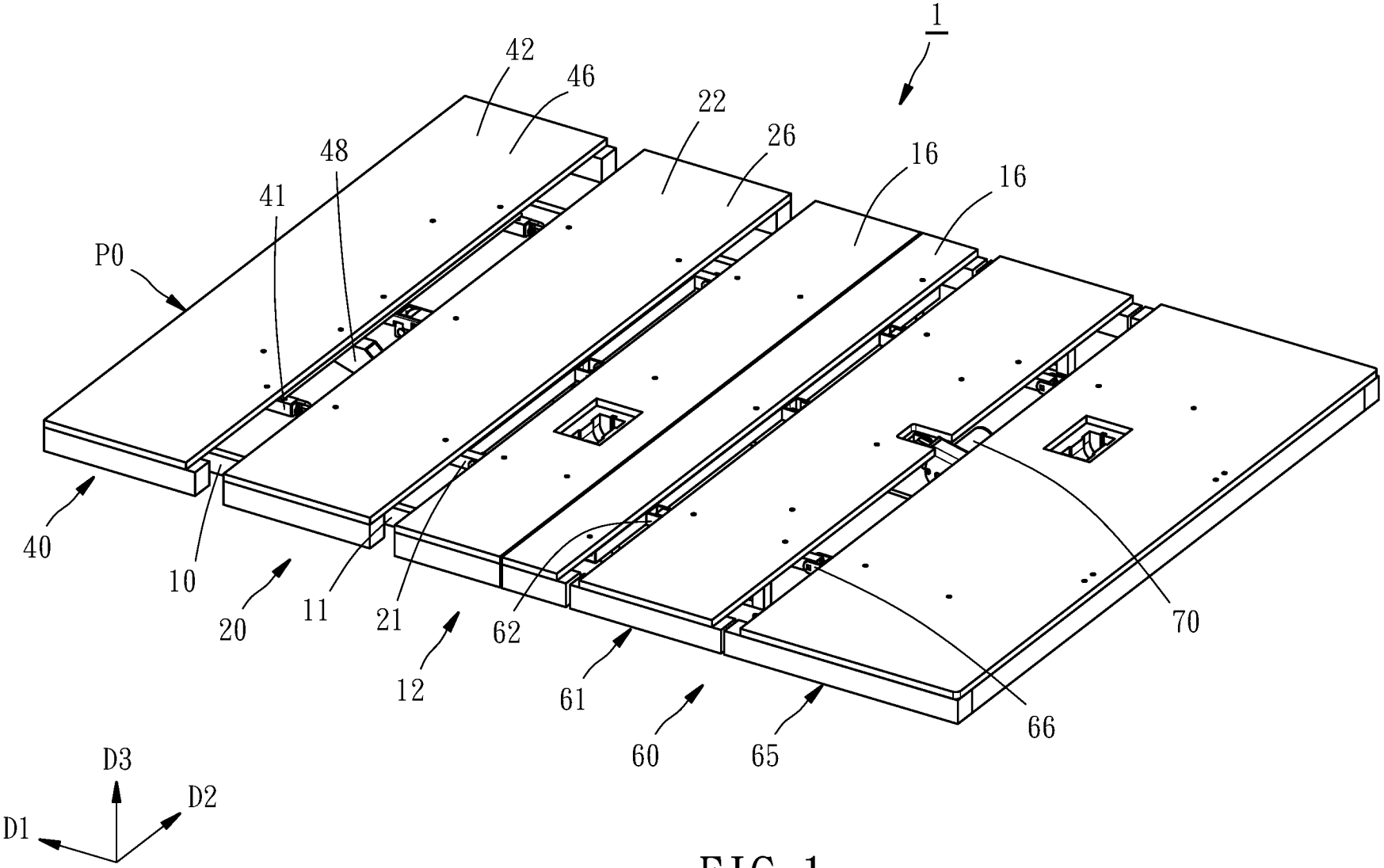
FIG. 1 is a perspective view of an electric bed according to an embodiment of the present invention.
Figure 2:
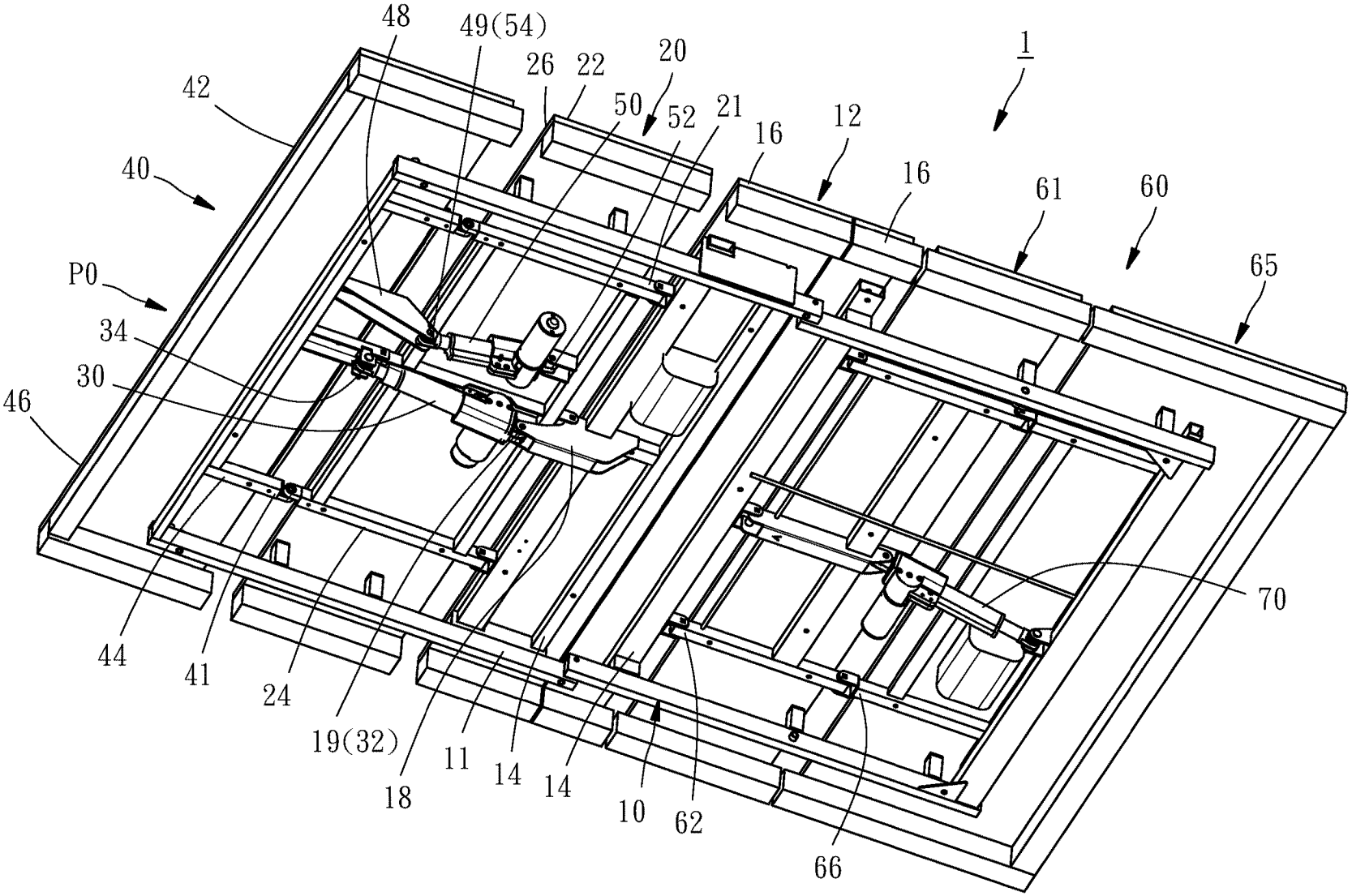
FIG. 2 is another perspective view of the electric bed according to the embodiment of the present invention.

The structure and technical features of the present invention will be detailedly described hereunder by an embodiment and accompany drawings. As shown in FIGS. 1 and 2, the electric bed 1 provided in accordance with an embodiment of the present invention is composed of a base 10, a back supporting unit 20, a first actuator 30, a head supporting unit 40, a second actuator 50, a leg supporting unit 60, and a third actuator 70.

The base 10 includes a rectangular frame 11 and a buttock supporting unit 12. The frame 11 is configured to be placed on the ground, a bed surface or a flat surface, and serves as a support base for supporting remaining elements. From the view angles of FIGS. 1 and 2, the head of the electric bed 1 is located at left side of the electric bed 1, and the tail of the electric bed 1 is located at right side. In the present invention, the direction of the bed head is defined as a front direction, and the direction of a bed tail is defined as a rear direction. In FIGS. 1 and 2, the direction D1 is defined as a back-and-forth direction, the direction D2 is defined as a right-and-left direction, and the direction D3 is defined as an up-and-down direction. The buttock supporting unit 12 is located on a middle section of the frame 11 and composed of a buttock supporting frame 14, two buttock supporting plates 16 disposed on the buttock supporting frame 14, and a pivot mount 18 downwardly and forwardly extending from the buttock supporting frame 14. The buttock supporting frame 14 is fixedly mounted with the frame 11. The two buttock supporting plates 16 are used to support a user's buttock. The buttock supporting plates 16 may, but not limited to, be made by wood, metal net, etc., and may be enveloped by foam pad to serve as cushion. The pivot mount 18 has a U-shaped cross-section having a top fixedly mounted to the buttock supporting frame 14 and being provided with two pivot holes 19 at the front end extending toward the bed head direction.

The back supporting unit 20 is located on the base 10 and provided with a rear end 21 pivotally connected with the buttock supporting frame 14 of the base 10. The back supporting unit 20 is provided at a top side thereof with a back supporting surface 22. Specifically, the back supporting unit 20 comprises a back supporting frame 24 and a back supporting plate 26 disposed on the back supporting frame 24. The back supporting plate 26 may, but not limited to, be made by wood, metal net, etc., and may be enveloped by foam pad to serve as cushion. The back supporting surface 22 is the top surface of the back supporting plate 26. The back supporting plate 26 is used to support the user's back.

Figure 7:
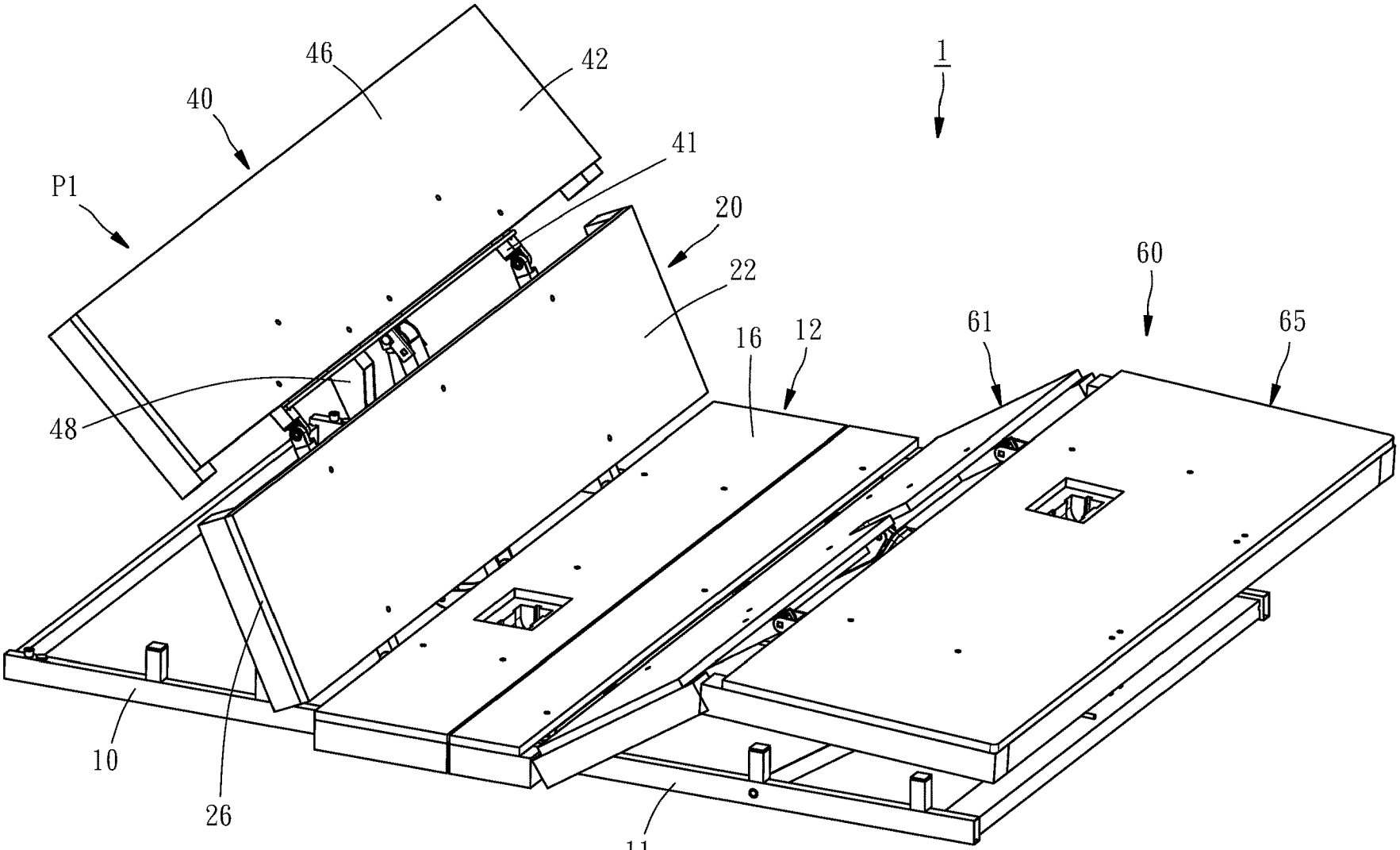
FIG. 7 is a perspective view showing the electric bed of the embodiment of the present invention in a state of a third posture.
Figure 8:
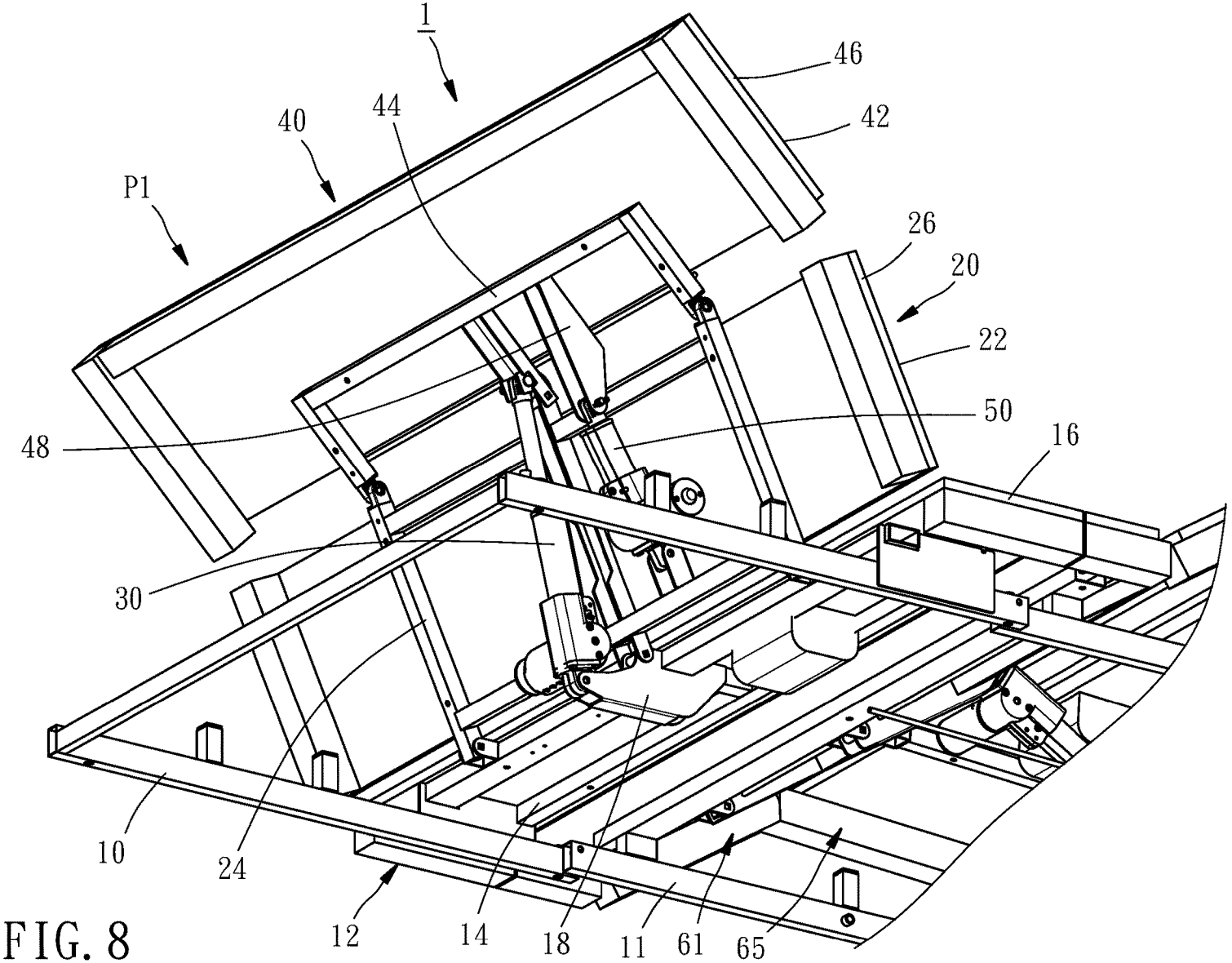
FIG. 8 is an enlarged perspective view showing a part of the electric bed of the embodiment of the present invention in the state of the third posture.

The first actuator 30 has two ends pivotally connected with the base 10 and the back supporting unit 20, respectively. As such, the back supporting unit 20 is drivenable by the first actuator 30 to upwardly and downwardly swing relative to the base 10. Specifically, the power source of the first actuator 30 may be electricity, compressed gas or oil. In this embodiment, the first actuator 30 is realized as an electric actuator including a telescopic rod. The first actuator 30 has a rear end 32, i.e., the end facing toward the bed tail, pivotally connected with the pivot mount 18 via the two pivot holes 19, and a front end 34, i.e., the end facing toward the bed head, pivotally connected with the front end of the back supporting frame 24. As a result, when the length of the first actuator 30 extends, the back supporting unit 20 is driven by the first actuator 30 to swing relative to the base 10 upwardly, as shown in FIGS. 7 and 8.

The head supporting unit 40 is disposed on the base 10 and has a rear end 41 pivotally connected with the back supporting unit 20, and a top side provided with a head supporting surface 42. Specifically, the head supporting unit 40 comprises a head supporting frame 44, a head supporting plate 46 disposed on the head supporting frame 44, and a pivot mount 48 downwardly and backwardly extending from the head supporting frame 44. The head supporting plate 46 may, but not limited to, be made by wood, metal net, etc., and may be enveloped by foam pad to serve as cushion. The head supporting surface 42 is the top surface of the head supporting plate 46. The head supporting plate 46 is used to support the user's head. The pivot mount 48 has an inverted U-shaped cross-section having a top fixedly mounted to the head supporting frame 44 and being provided with two pivot holes 49 at the rear end extending toward the bed tail direction. According to statistic data, the distance from shoulder to the top of the head of human being is about 10 to 12 inches, and the distance from the top of the head of a person sleeping in a normal posture to the head of the bed is about 2 to 3 inches; therefore, the length of the head supporting plate 46 of the head supporting unit 40 in the back-and-forth direction D1 is designed to be preferably about 9 to 16 inches, and more preferably 13 to 15 inches in order to fulfil the requirement of ergonomics.

The second actuator 50 has two ends pivotally connected with the back supporting unit 20 and the head supporting unit 40, respectively. As such, the head supporting unit 40 is drivenable by the second actuator 50 to reciprocatingly swing among an initial position P0, a head-up position P1, and a head-down position P2 relative to the back supporting unit 20. Specifically, the power source of the second actuator 50 may be electricity, compressed gas or oil. In this embodiment, the second actuator 50 is realized as an electric actuator including a telescopic rod. The second actuator 50 has a rear end 52, i.e., the end facing toward the bed tail, pivotally connected with the rear end of the back supporting frame 24, and a front end 54, i.e., the end facing toward the bed head, pivotally connected with the pivot mount 48 via the two pivot holes 49.

Figure 3:
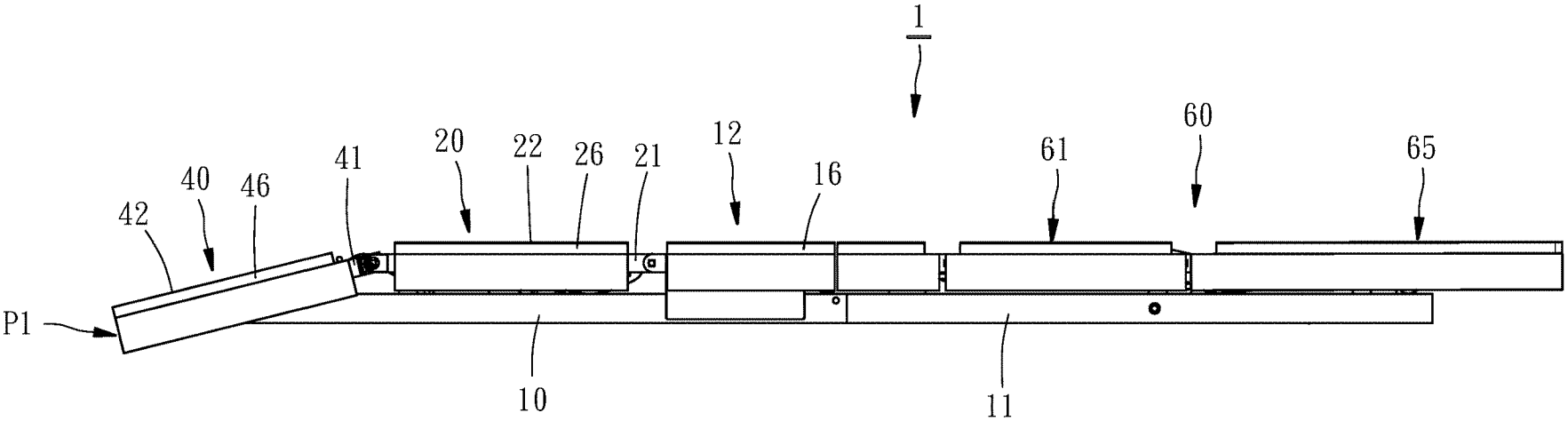
FIG. 3 is a perspective view showing the electric bed of the embodiment of the present invention in a state of a first posture.
Figure 4:
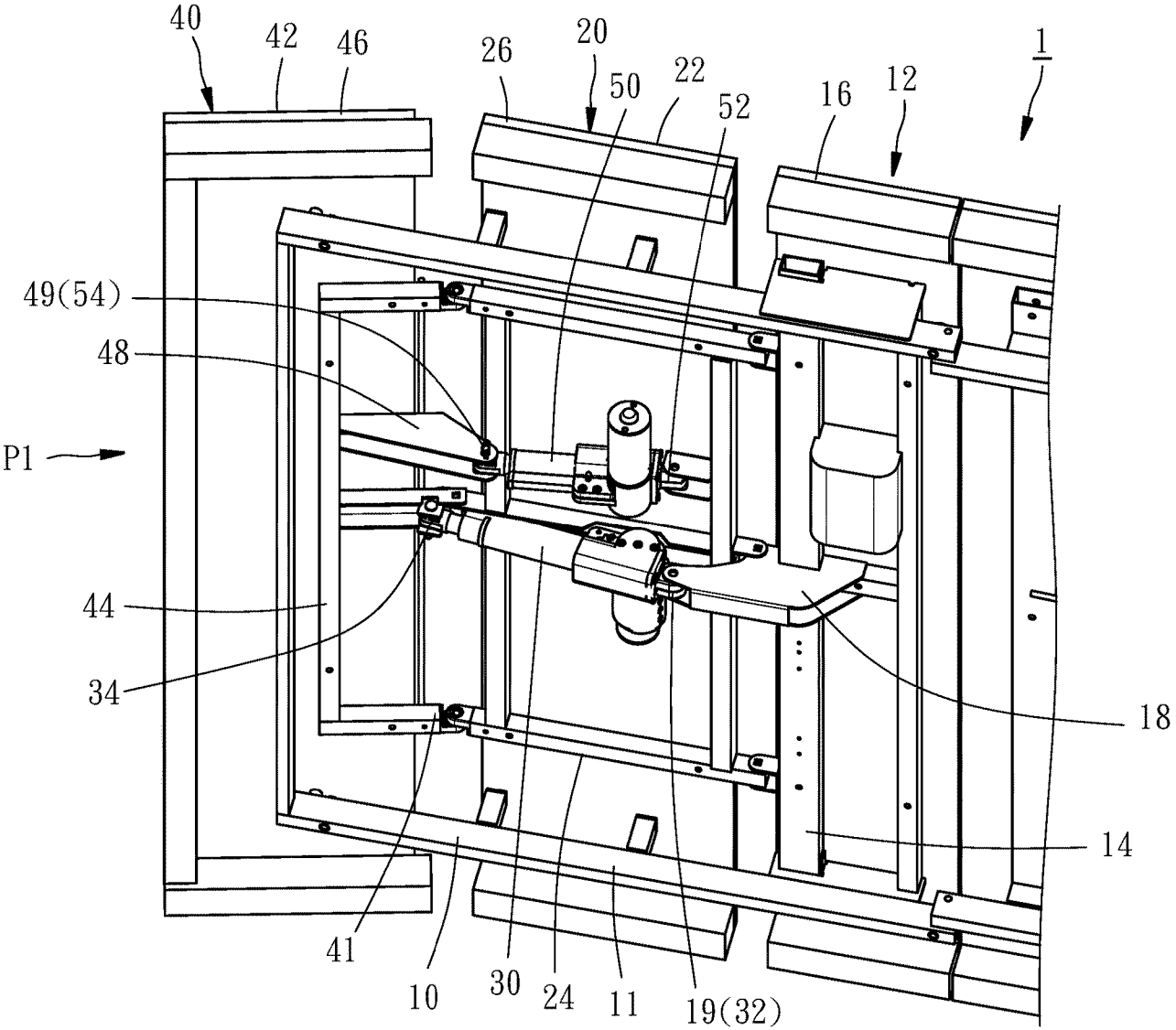
FIG. 4 is an enlarged perspective view showing a part of the electric bed of the embodiment of the present invention in the state of the first posture.
Figure 5:
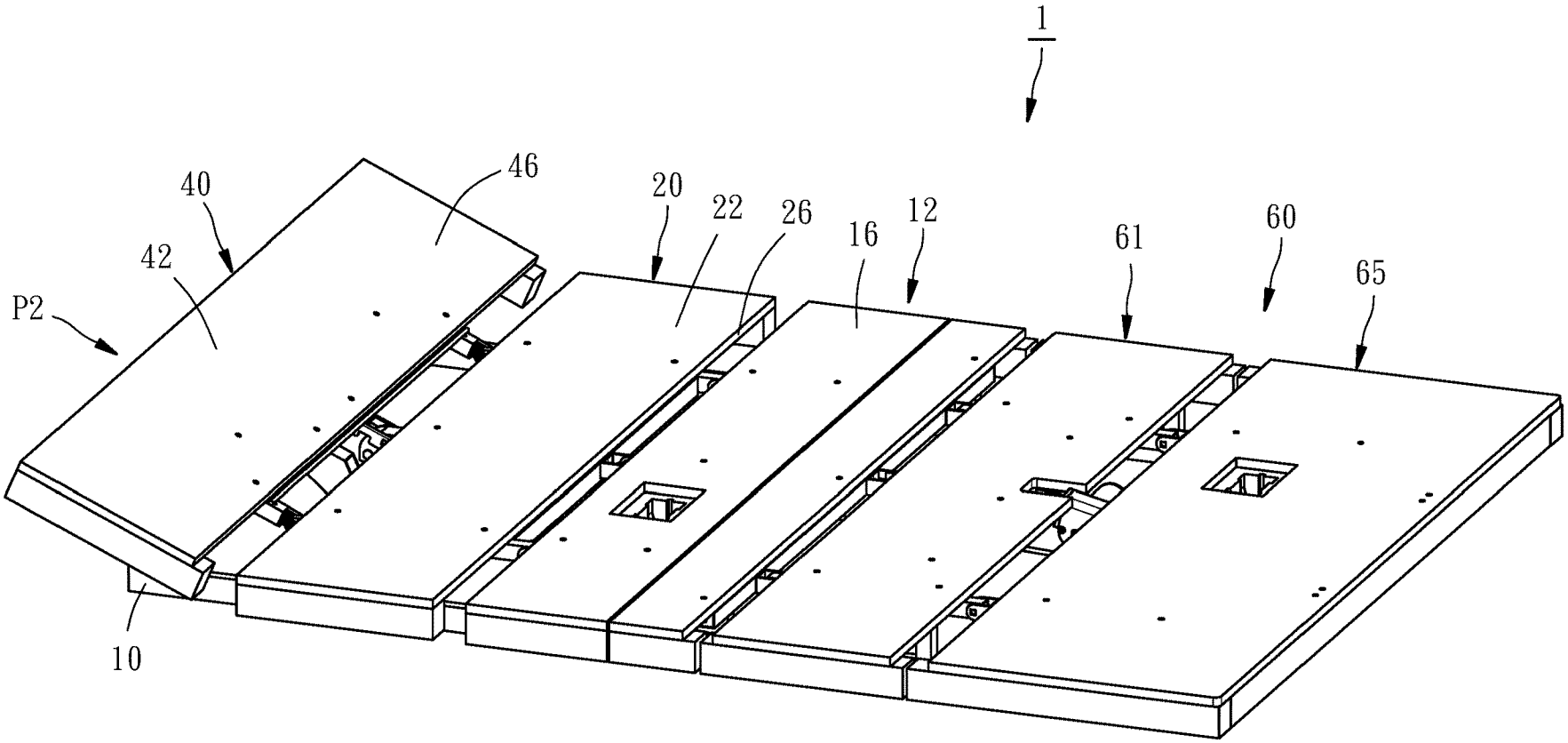
FIG. 5 is a perspective view showing the electric bed of the embodiment of the present invention in a state of a second posture.
Figure 6:
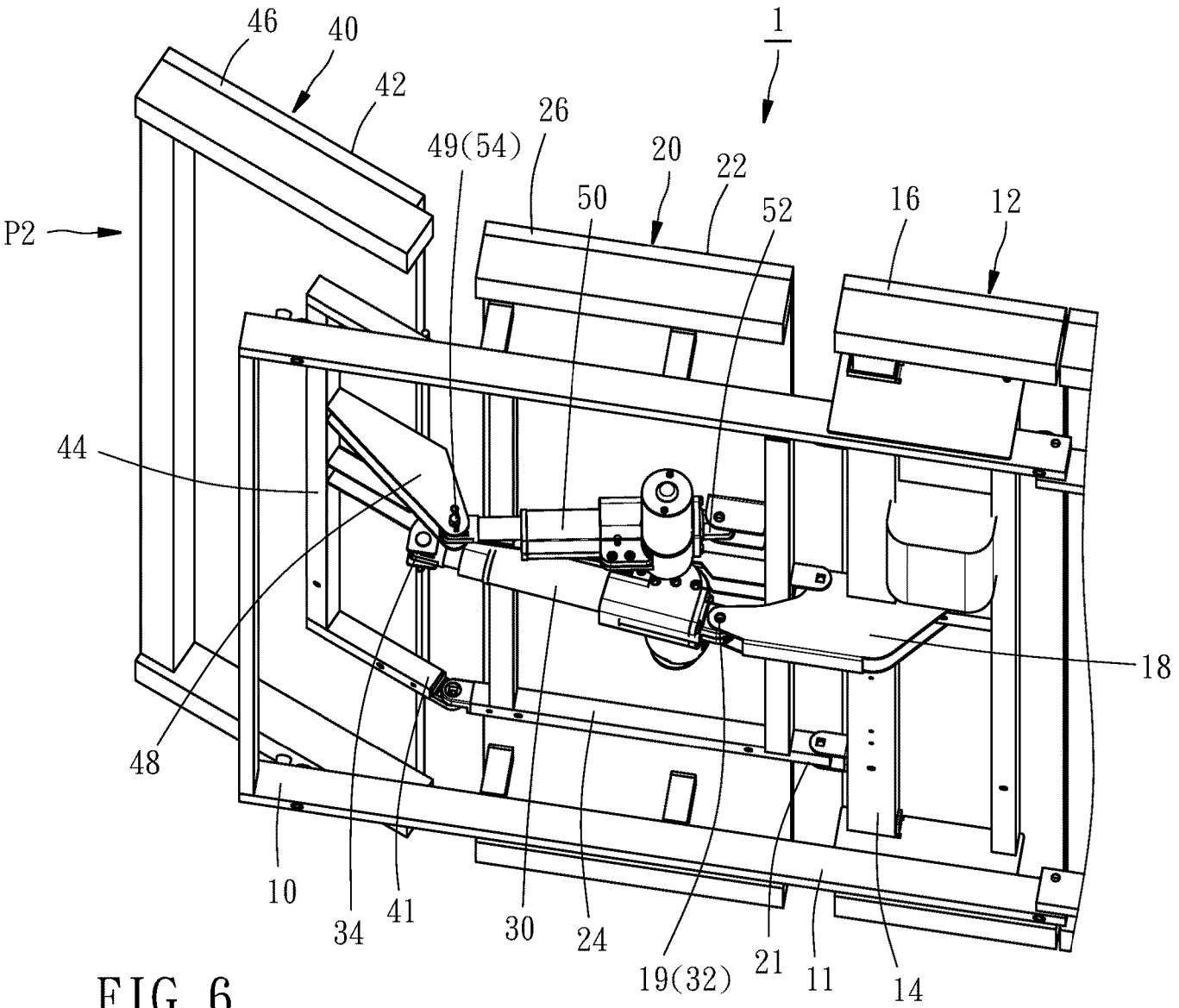
FIG. 6 is an enlarged perspective view showing a part of the electric bed of the embodiment of the present invention in the state of the second posture.

As shown in FIGS. 1 and 2, when the head supporting unit 40 stays at the initial position P0, the head supporting surface 42 is flush with the back supporting surface 22. In such circumstance, the head supporting surface 42 and the back supporting surface 22 are both located at a same imaginary plane in this embodiment. As shown in FIGS. 3 and 4, the head-up position P1 of the head supporting unit 40 is lower than the initial position P0. Specifically, when the length of the second actuator 50 shortens, i.e., when the telescopic rod of the second actuator 50 retracts, the head supporting unit 40 is forced by the second actuator 50 to swing downwardly to the head-up position P1. In this head-up position P1, the head supporting surface 42 is defined with the back supporting surface 22 an included angle ranging from 10 degrees to 30 degrees. As shown in FIGS. 3 and 4, the included angle between the head supporting surface 42 and the back supporting surface 22 is about 20 degrees. In this way, a user lying on the electric bed 1 can comfortably lie on his/her stomach to take a rest or to facilitate a back massage. Alternatively, a user can lie on the electric bed 1 in a head-up posture, i.e., the user's head tilts backwardly and upwardly to become a chin-up manner. This newly developed supporting posture of the electric bed 1 is never seen in prior arts. In another aspect, as shown in FIGS. 5 and 6, the head-down position P2 of the head supporting unit 40 is higher than the initial position P0. Specifically, when the length of the second actuator 50 enlarges, i.e., when the telescopic rod of the second actuator 50 extends, the head supporting unit 40 is forced by the second actuator 50 to swing upwardly to the head-down position P2. In this head-down position P2, the head supporting surface 42 is defined with the back supporting surface 22 an included angle ranging from 150 degrees to 170 degrees. As shown in FIGS. 5 and 6, the included angle between the head supporting surface 42 and the back supporting surface 22 is about 160 degrees. In this way, the head of a user lying on the electric bed 1 can be supported by the head supporting unit 40 in a head-down posture, i.e., the user's head tilts forwardly and downwardly to become a chin-down manner. Moreover, as shown in FIGS. 7 and 8, when the first actuator 30 extends, the back supporting unit 20 is driven by the first actuator 30 to swing upwardly. At the same time, the second actuator 50 may retracts to drive the head supporting unit 40 to the head-up position P1. As a result, the user may rest on the electric bed 1 in a posture that the user's back is lifted and the user's head tilts backwardly and upwardly. This newly developed supporting posture of the electric bed 1 is not seen in prior arts, either.

The leg supporting unit 60 comprises a thigh supporting unit 61 and a lower leg supporting unit 65. The thigh supporting unit 61 has a structural design similar to that of the back supporting unit 20. The thigh supporting unit 61 has a front end 62 pivotally connected with the buttock supporting frame 14. The lower leg supporting unit 65 has a structural design similar to that of the back supporting unit 20, too. The lower leg supporting unit 65 has a front end 66 pivotally connected with the thigh supporting unit 61.

The third actuator 70 has two ends pivotally connected with the base 10 and the thigh supporting unit 61. In this way, the thigh supporting unit 61 is drivenable by the third actuator 70 to swing relative to the base 10 upwardly and downwardly, and the lower leg supporting unit 65 is moved along with the thigh supporting unit 61 upwardly and downwardly, as shown in FIG. 7. That is, when the third actuator 70 extends, the thigh supporting unit 61 and the lower leg supporting unit 65 are lifted upwardly.

With the above-mentioned structural design, the electric bed 1 provided by the present invention can change a support angle to a user's head to enable the user to lie on his/her stomach comfortably, and can support the user in a head-up manner. This newly developed supporting posture is not seen in the prior arts, can fulfill various needs and requirements of users, and can avoid the respiratory passage of the user from blockage to effectively relieve snoring phenomenon, thereby achieving the objectives of the present invention.

Figure 9:
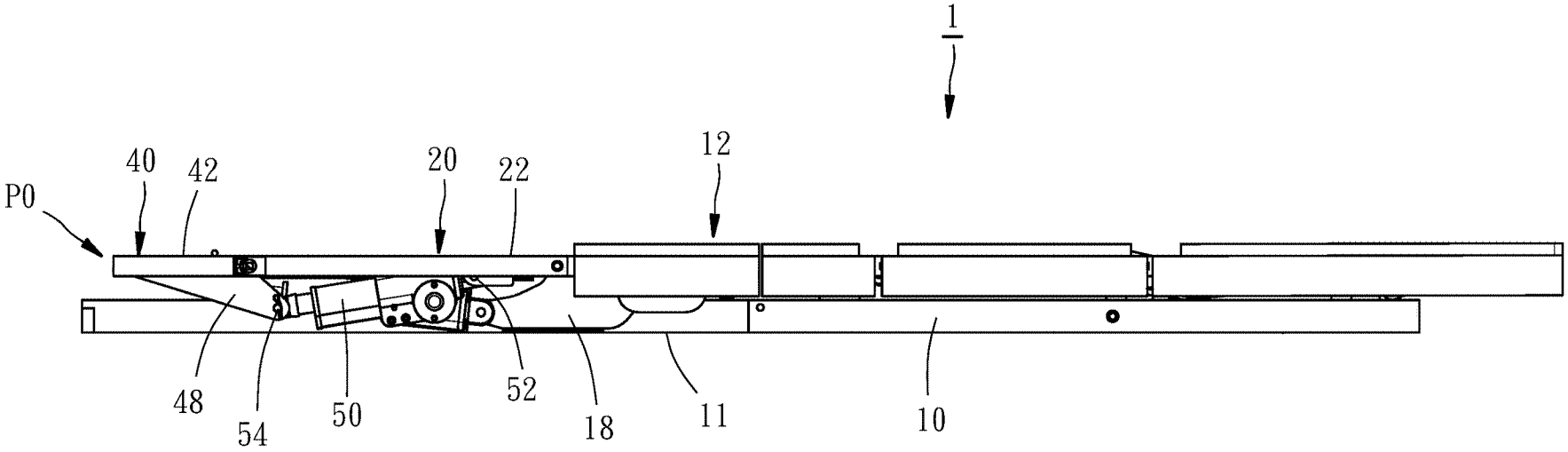
FIG. 9 is a lateral elevational view of the electric bed according to the embodiment of the present invention.

Further, as shown in FIG. 9, when the head supporting unit 40 stays at the initial position P0, the end (i.e., the front end 54) of the second actuator 50, which is pivotally connected with the head supporting unit 40, is lower in elevation than the other end (i.e., the rear end 52) of the second actuator 50, which is pivotally connected with the back supporting unit 20. This structural arrangement provides a sufficient torque to effectively drive the head supporting unit 40 to swing upwardly or downwardly when the second actuator 50 retracts or extends. Furthermore, when the head supporting unit 40 stays at the initial position P0, a bottom of the pivot mount 48 of the head supporting unit 40 is not lower in elevation than a bottom of the base 10 (i.e., the bottom of the frame 11), and a bottom of the pivot mount 18 of the buttock supporting unit 12 is not lower in elevation than a bottom of the base 10. As a result, the electric bed 1 of the present invention not only provides a newly developed supporting posture and a support angle to tilt a user's head backwardly and upwardly but also provides a thin overall thickness to facilitate transportation and storage with advantages of great flexibility in installation, convenience in usage, and great market potential.

Figure 10:
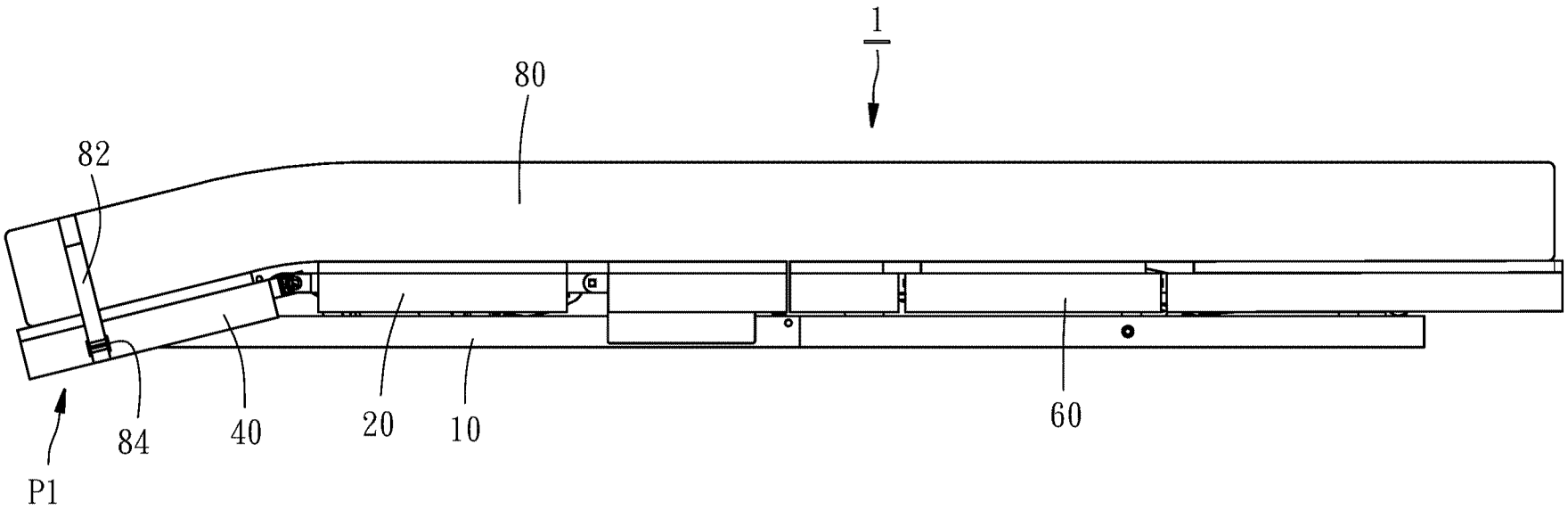
FIG. 10 is schematic view showing that a mattress is provided with the electric bed of the embodiment of the present invention.

Referring to FIG. 10, the back, head, buttock and leg supporting units 20, 40, 12 and 60 are used to support a mattress 80 thereon. To ensure that the mattress 80 will swing along with the head supporting unit 40 when the head supporting unit 40 reciprocatingly swings relative to the back supporting unit 20 upwardly and downwardly, a tying strip 82 extending along the right-and-left direction D2 is used to tie the mattress 80 and the head supporting unit 40 together. In this way, the mattress 80 is still moveable relative to the head supporting unit 40 in the back-and-forth direction D1. For example, when the head supporting unit 40 stays at the initial position P0, the front edge of the mattress 80 is flush with the front edge of the head supporting plate 46, and when the head supporting unit 40 moves to the head-up position P1, the front edge of the mattress 80 may backwardly move relative to the head supporting plate 46. When the front section of the mattress 80 is bent, this structural arrangement can avoid a forward movement of the mattress 80 that may cause loading increase of the second actuator. On the contrary, when the head supporting unit 40 moves to the head-down position P2, the front edge of the mattress 80 may forwardly move relative to the head supporting plate 46, thereby avoiding creases of the mattress 80 that may cause loading increase of the second actuator 50 when the front section of the mattress 80 is bent. In this embodiment, the tying strip 82 is realized as a hook-and-loop fastening belt equipped with a ring buckle 84, thereby facilitating adjustment of tightening degree of the tying strip 82. However, any fastening element enabling that the mattress 80 is swingable along with the head supporting unit 40 and moveable relative to the head supporting unit 40 in the back-and-forth direction D1 can be used.

Based on the technical features of the present invention, various modifications to the electric bed 1 may be made. For example, when the head supporting unit 40 stays at the head-up position P1, the included angle between the head supporting surface 42 and the back supporting surface may be adjusted and set in an range from 1 degree to 40 degrees in accordance with actual need and requirement. The third actuator 70 may be omitted, such that the leg supporting unit 60 may be configured as a stationary unit or may be adjustable manually. Such variations are not to be regarded as a departure from the spirit and scope of the invention, and all such modifications as would be obvious to one skilled in the art are intended to be included within the scope of the following claims.

What is claimed is:

1. An electric bed comprising:

a base;

a back supporting unit having an end pivotally connected with the base, and a top side provided with a back supporting surface;

a first actuator having two ends respectively and pivotally connected with the base and the back supporting unit in a way that the back supporting unit is driven by the first actuator to upwardly and downwardly swing relative to the base;

a head supporting unit having an end pivotally connected with the back supporting unit, and a top side provided with a head supporting surface; and a second actuator having two ends respectively and pivotally connected with the back supporting unit and the head supporting unit in a way that the head supporting unit is driven by the second actuator to swing between an initial position and a head-up position relative to the back supporting unit;

wherein when the head supporting unit stays at the initial position, the head supporting surface is flush with the back supporting surface;

wherein the head supporting unit is driven by the second actuator to swing downwardly from the initial position to the head-up position where the head supporting unit is lower than the head supporting unit at the initial position.

2. The electric bed as claimed in claim 1, wherein the head supporting unit is driven by the second actuator to swing to a head-down position relative to the back supporting unit; the head-down position is higher than the initial position.

3. The electric bed as claimed in claim 1, wherein when the head supporting unit stays at the initial position, one of the two ends of the second actuator, which is pivotally connected with the head supporting unit, is lower than the other of the two ends of the second actuator, which is pivotally connected with the back supporting unit.

4. The electric bed as claimed in claim 1, wherein the head supporting unit comprises a head supporting frame, a head supporting plate disposed on the head supporting frame, and a pivot mount downwardly extending from the head supporting frame; one of the two ends of the second actuator is pivotally connected with the pivot mount.

5. The electric bed as claimed in claim 4, wherein when the head supporting unit stays at the initial position, a bottom of the pivot mount is not lower than a bottom of the base.

6. The electric bed as claimed in claim 1, wherein when the head supporting unit stays at the head-up position, the head supporting surface is defined with the back supporting surface an included angle ranging from 10 degrees to 30 degrees.

7. The electric bed as claimed in claim 1, wherein the back supporting unit comprises a back supporting frame and a back supporting plate disposed on the back supporting frame; the base comprises a buttock supporting unit comprising a buttock supporting frame, a buttock supporting plate disposed on the buttock supporting frame, and a pivot mount downwardly extending from the buttock supporting frame; one of the two ends of the first actuator is pivotally connected with the pivot mount, and the other of the two ends of the first actuator is pivotally connected with the back supporting frame.

8. The electric bed as claimed in claim 7, wherein a bottom of the pivot mount of the buttock supporting unit is not lower than a bottom of the base.

9. The electric bed as claimed in claim 1, wherein the head supporting unit has a length ranging from 9 inches to 16 inches.

10. The electric bed as claimed in claim 1, comprising a mattress disposed on the back supporting unit and the head supporting unit, and a tying strip sleeving and tying the head supporting unit and the mattress together in a way that the mattress is swingable along with the head supporting unit and moveable relative to the head supporting unit in a back-and-forth direction.

* * * * *